US009500420B2

(12) United States Patent
Widder et al.

(10) Patent No.: US 9,500,420 B2
(45) Date of Patent: Nov. 22, 2016

(54) CASELESS PROJECTILE AND LAUNCHING SYSTEM

(71) Applicant: Battelle Memorial Institute, Columbus, OH (US)

(72) Inventors: Jeffrey M. Widder, Bel Air, MD (US); Christopher A. Perhala, Dublin, OH (US); James R. Rascoe, Bel Air, MD (US)

(73) Assignee: Battelle Memorial Institute, Columbus, OH (US)

( * ) Notice: Subject to any disclaimer, the term of this patent is extended or adjusted under 35 U.S.C. 154(b) by 153 days.

(21) Appl. No.: 14/367,517

(22) PCT Filed: Dec. 20, 2012

(86) PCT No.: PCT/US2012/070934

§ 371 (c)(1),
(2) Date: Jun. 20, 2014

(87) PCT Pub. No.: WO2013/187931

PCT Pub. Date: Dec. 19, 2013

(65) Prior Publication Data

US 2014/0352188 A1 Dec. 4, 2014

Related U.S. Application Data

(60) Provisional application No. 61/578,019, filed on Dec. 20, 2011.

(51) Int. Cl.
*F41A 1/06* (2006.01)
*F42B 5/184* (2006.01)
(Continued)

(52) U.S. Cl.
CPC ..... *F41A 1/06* (2013.01); *F41A 21/00* (2013.01); *F42B 5/18* (2013.01); *F42B 5/184* (2013.01); *F42B 15/00* (2013.01)

(58) Field of Classification Search
CPC ..... F41A 1/06; F41A 21/00; F41A 21/28; F41A 19/03; F42B 15/00; F42B 5/18; F42B 5/181; F42B 5/182; F42B 5/184
USPC ..... 89/193
See application file for complete search history.

(56) References Cited

U.S. PATENT DOCUMENTS 1,431,059 A * 10/1922 Sutter ..... 89/193
1,559,183 A * 10/1925 Rimailho ..... 89/1.3
(Continued)

FOREIGN PATENT DOCUMENTS

AU DE 264618 * 0/1912
CH 498361 10/1970
(Continued)

OTHER PUBLICATIONS

"*Modified M16 for Lethal/Non-Lethal Attack*", Jane's International Defence Review, vol. 29, pp. 20, 1996.

*Primary Examiner* — Joshua Freeman
(74) *Attorney, Agent, or Firm* — Diederiks & Whitelaw, PLC

(57) ABSTRACT

A launcher system includes a launcher having a barrel adapted to receive a projectile and a charge of propellant and a velocity variator configured to shift relative to barrel to selectively vary a launch velocity of projectile from launcher. The velocity variator may be constituted by a collar selectively controlling the propellant gases vented out of projectile and into barrel and/or a sliding breech face behind which is an energy-absorbing plug.

20 Claims, 18 Drawing Sheets

(51) Int. Cl.

| | |
|---|---|
| ***F41A 21/00*** | (2006.01) |
| ***F42B 5/18*** | (2006.01) |
| ***F42B 15/00*** | (2006.01) |

(56) References Cited

U.S. PATENT DOCUMENTS

| | | | | |
|---|---|---|---|---|
| 1,864,374 | A * | 6/1932 | Schuler et al. | 42/76.01 |
| 2,863,394 | A * | 12/1958 | Losfeld | 102/498 |
| 3,212,402 | A | 10/1965 | Hengel et al. | |
| 3,307,451 | A * | 3/1967 | Bucklisch et al. | 89/1.701 |
| 3,380,344 | A * | 4/1968 | Bucklisch et al. | 89/14.3 |
| 3,946,637 | A * | 3/1976 | Campagnuolo et al. | 89/1.3 |
| 5,097,614 | A * | 3/1992 | Strong | 42/76.01 |
| 5,479,736 | A * | 1/1996 | Forrester | 42/72 |
| 5,992,291 | A * | 11/1999 | Widder et al. | 89/14.05 |
| 6,131,515 | A | 10/2000 | Cook et al. | |
| 6,134,823 | A | 10/2000 | Griffin | |
| 6,374,720 | B1 * | 4/2002 | Tedde | 89/193 |
| 7,021,219 | B1 | 4/2006 | Dindl | |
| 8,342,097 | B1 * | 1/2013 | Widder et al. | 102/501 |
| 2006/0283068 | A1 * | 12/2006 | Beretta | 42/76.01 |

FOREIGN PATENT DOCUMENTS

| | | |
|---|---|---|
| EP | 0661513 | 7/1995 |
| EP | 2131135 | 12/2009 |

* cited by examiner

CASELESS PROJECTILE AND LAUNCHING SYSTEM

CROSS REFERENCE TO RELATED APPLICATIONS

The present application represents a National Stage application of PCT/US2012/070934, filed Dec. 20, 2012, entitled "Caseless Projectile and Launching System", pending, which claims the benefit of U.S. Provisional Patent Application Ser. No. 61/578,019, filed Dec. 20, 2011, entitled "Caseless Projectile and Launching System", the entire contents of these applications are incorporated herein by reference.

BACKGROUND OF THE INVENTION

Field of the Invention

The present invention pertains to the field of weaponry and, more particularly, to a caseless projectile and an associated launching system used for both non-lethal and lethal applications.

Discussion of the Prior Art

In general, most firearms or weapons have employed bullets, which are typically fired through a relatively heavy barrel. Usually a cartridge including a bullet, a casing and smokeless propellant located in the casing is employed. Conventional hand carried weapons are typically fired by pulling a trigger which allows a movable firing pin to impact the aft end of the bullet cartridge to initiate a primer and ignite the smokeless propellant located in the bullet cartridge such that the bullet is fired out the barrel. When the firearm is fired, the bullet will have an initial high acceleration caused by high temperature and pressure of gases that propel the bullet through the barrel. Typically, the high temperature and high pressure gases are formed by the ignition of the smokeless propellant and since the deflagration of the propellant releases large amounts of energy and heat, the weapon has to be made of a very heavy durable material, usually metal. The disadvantage of such construction is that the barrel is extremely heavy and is not really suitable for light-weight non-lethal applications.

In order to provide non-lethal systems, some weapons have been designed to fire multiple frangible projectiles, often launched using air from compressed air bottles. Typically, extra air bottles and a compressor to refill empty bottles are required for sustained operations and the whole arrangement tends to be relatively heavy, while requiring a high logistic burden. Other non-lethal systems typically use a blunt, relatively large projectile that is cumbersome to transport and fire. In certain cases, non-lethal projectiles are designed to be used with launchers built for lethal ammunition. For instance, manually operated shotguns can be used to fire non-lethal ballistics such as beanbags and rubber projectiles, and non-lethal grenades from a muzzle-mounted launcher. However, such arrangements typically lack accuracy and cannot be switched to lethal fire in an efficient manner.

The most advanced prior art blunt impact projectiles are considered to be propelled either by standard style gun propellants or compressed gas. Compressed gas guns utilize a cylinder of compressed air or a gas such as carbon dioxide to propel the projectile and operate the action of the launcher so that multiple rapid follow-up shots can be achieved. Compressed gas launchers can have an advantage of rapid semi-automatic fire at the expense of a large amount of logistics associated with the transport and filling of compressed air tanks needed to operate the launcher. Certainly, solid propellant driven non-lethal weapons have an advantage of decreased logistical burdens. However, they are often not capable of the same fire rate as the compressed air guns because the weapon has to be operated manually to reload for successive shots. In general, solid propellant driven non-lethal ammunition lacks the energy to reliably operate an automatic or semi-automatic reloading mechanism of a weapon designed to fire high-pressure ammunition. This deficiency can be overcome, at least to some extent, by the use of telescoping casings, if the action is of a straight blow back design, as has been done for certain grenade launchers. However, these known launchers employ projectiles which are both expensive and large, thereby requiring a large volume for ammunition storage and greatly reducing the readiness of the launcher for lethal applications.

In general, the use of non-lethal ammunition in weapons that are otherwise used to fire lethal ammunition compromises the safety of the user by decreasing the readiness to respond with lethal force when necessary. Therefore, as can be seen from the above discussion, there is considered to be a need in the art for a non-lethal weapon that is compact and can achieve a high rate of fire without large logistical burdens, such as those associated with compressed gas guns which have gas bottles that need to be supplied and/or filled. In addition, there is a need for a weapon that is mechanically simpler, smaller and lighter than prior art compressed air or gas non-lethal weapons. Furthermore, there is a need in the art for a launcher which is small enough and light enough to mount under or to the side of the barrel of a known lethal weapon, such as an M16 rifle, without degrading the readiness or lethal performance of the rifle. Finally, there is a need in the art to provide ammunition in the form of projectiles which can be in either non-lethal or lethal form yet still be fired from the same launcher.

SUMMARY OF THE INVENTION

In general, the present invention includes a captive piston driven rocket assisted projectile and a lightweight magazine fed launcher that has a small number of moving parts relative to prior art designs. Essentially, there are two embodiments for the launcher, with one embodiment having the projectile's propellant ignited mechanically and the other embodiment having the propellant ignited electrically. In each embodiment, the launcher includes a barrel adapted to receive the projectile and a trigger that activates the projectile. A bracket is attached to the barrel for allowing the launcher to be attached to a conventional rifle or carbine. Preferably, the barrel is made from lightweight plastic with a thin rifled steel liner, and a magazine is provided for storing additional projectiles to be supplied to the barrel.

The projectile includes an outer body with a central bore, a front wall and a rear wall. A central piston hole is located in the rear wall and aligned with the central bore. At least one radially positioned vent hole is located in the rear wall near the central piston hole. A piston is slidably mounted in the bore and adapted to shift from a retracted position near the front wall to an extended position wherein the piston extends through the piston hole and projects partially out of the outer body. A retainer is mounted in the outer body or integrally formed therewith for retaining the piston within the bore. Gas-generating solid propellant is mounted in the bore near the front wall. Preferably, the propellant is shaped into a cylinder and mounted in the central bore so that the piston slides within the cylinder or the propellant is a powder that is packed into the cylinder bore in front of the piston and the primer is located between the piston head and propellant. With this arrangement, when a trigger is pulled, the projectile is activated by igniting the propellant and pushing the piston along the bore through the piston hole so the piston pushes against the launcher while the piston moves from the retracted position to the extended position to provide an initial thrust while the piston is in the bore. The propellant gasses then exit the bore through the at least one radially positioned vent hole to provide an additional thrust for the projectile when the projectile exits the bore. Preferably, three vent holes are equally spaced around the central piston hole. The outer body is made from an injection moldable material with steel or aluminum inserts. The outer body has either a uniform cross-section or each of the front wall of the outer body and the rear wall of the outer body has a larger circular cross section than the outer circular cross section of a central portion of the outer body.

In the mechanically initiated embodiment, the launching system is used by placing a projectile in the launcher and then initiating the propellant located in the projectile. Initiating the propellant includes striking the projectile with a trigger activated hammer. The hammer hits the front wall of the projectile to cause the primer located in the ogive to impact a protrusion on the piston head. The impact initiates the priming compound that ignites the propellant. When the propellant is ignited, the propellant burns or decomposes into gas, forcing the piston to extend from the projectile and push against the launcher thus propelling the projectile from the launcher. More specifically, the propellant pushes the piston head and ogive apart. As they move apart, the piston is forced against the breech face, which results in the projectile body moving towards the muzzle. Relative to the projectile body, the piston shifts along the bore from the retracted position through the piston hole to the extended position to provide an initial thrust while the piston is in the bore and then the propellant exits the bore through at least one vent hole to provide an additional thrust for the projectile. Propellant gas is vented out of the projectile through at least one vent hole after the projectile leaves the launcher to provide additional thrust for the projectile and to safely discharge pressure from within the projectile. Preferably, multiple vent holes are used which are equally spaced around the base of the projectile to balance the thrust forces from each vent to maintain a stable flight of the projectile.

In the electronically initiated embodiment, the projectile forms a circuit with the launcher and is actuated by the trigger. Specifically, the circuit travels through a capacitor and also through a priming compound located in a primer or a reactive semiconductor bridge next to the propellant. When the capacitor discharges in response to movement of the trigger, a current is sent through the circuit so that the current ignites the priming compound or causes the reactive semiconductor bridge to create plasma, thereby directly initiating the propellant.

In accordance with either embodiment of the invention, the launching system may be used with projectiles specifically made to be non-lethal or lethal. In each case, the propellant preferably accelerates the projectile both in the barrel and after leaving the barrel. However, the manner of acceleration and the final velocity in each case differs. In the non-lethal projectile, the propellant is present in an amount for preferably accelerating the projectile in the barrel to less than 300 feet per second and the front wall of the outer body is compliant and in the shape of a blunt dome so that the projectile impacts a target with non-lethal force. In the lethal projectile, the propellant is present in an amount for primarily accelerating the projectile after it leaves the barrel to greater than 800 feet per second and the front wall is not compliant with a sharp ogive so that the projectile is able to impact a target with deadly force.

In accordance with another embodiment of the invention, the launcher is provided with a mechanism to vary the launch velocity by selectively controlling the propellant gases vented out of the projectile and into the barrel. Specifically, vent holes are formed in the barrel near a breech and covered with a collar. The collar is preferably incorporated into a bolt action-type launcher and is provided with passageways and can be rotated to line up the passageways with the vent holes in an open configuration in order to allow propellant gases to vent out of the barrel or to have the passageways not line up with the vent holes in a closed configuration to prevent propellant gases from venting out of the barrel. Alternatively, the collar is configured to slide axially relative to the launcher to move from the open configuration to the closed configuration. When the collar is in the closed configuration, propellant gases build up pressure behind the projectile resulting in a relatively high launch velocity and, when the collar is in the open configuration, a relatively low launch velocity is produced. Preferably, finer control of the launch velocity is achieved by using a variable control of the venting gas. As the collar is moved to line up the passageways with the vent holes, a certain area of the vent holes, also known as a vent area, are left uncovered and allow gas to pass there through. Variation of the vent area is preferably either incremental or continuous to provide finer control of the final launch velocity. Preferably, incremental control of the vent area is provided by a series of stops or detents while continuous variation of the vent area uses friction between the collar and the barrel to prevent movement of the collar except by intentional adjustment through a handle.

In accordance with yet another embodiment of the invention, a sliding breech having a breech face is provided in the launcher and an energy-absorbing plug is located behind the sliding breech face. A locking pin is provided in the sliding breech and cooperates with a slot in the breech body (or bolt body in the case of a bolt action launcher). The slot is shaped so that, when the locking pin is in a locked position, the breech face is prevented from moving when a projectile is launched. However, when the locking pin is in an unlocked position, the breech face moves rearward when the piston from the projectile extends out of the main body of the projectile as the projectile is launched. Since the plug absorbs energy from the piston, less energy is imparted to the projectile and, as a result, the launch velocity of the projectile is reduced when the locking pin is in the unlocked position and increased when the locking pin is in the locked position. The vented collar and the energy-absorbing plug are usable together to provide greater control of the projectile's launch velocity.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
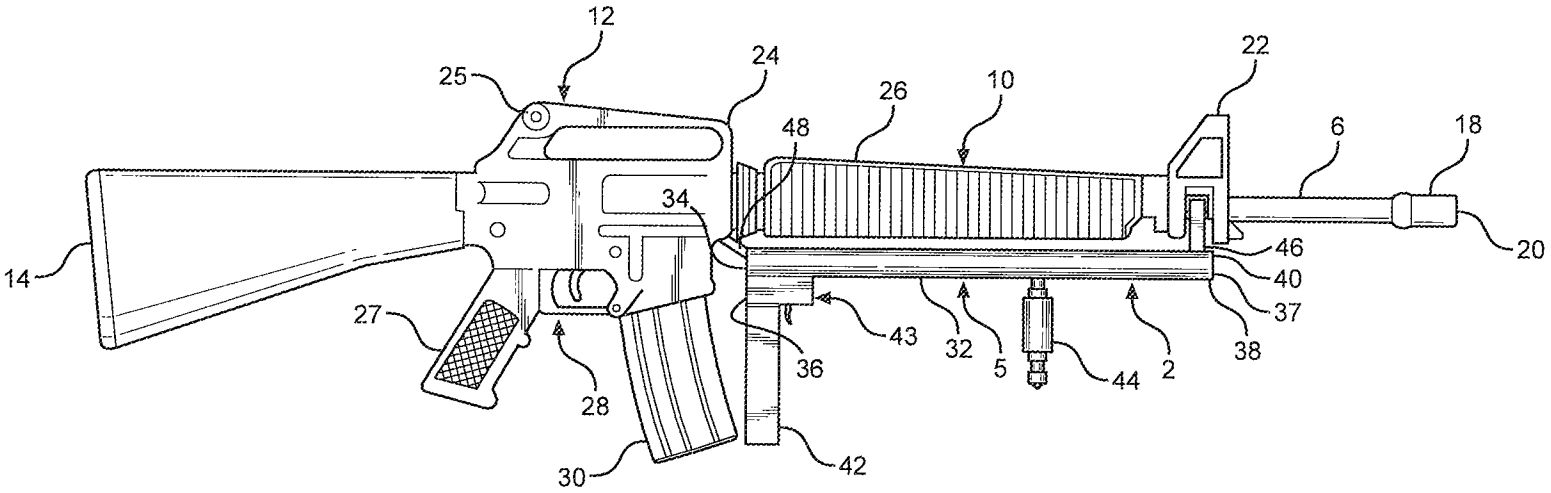
FIG. 1 is a side view of a magazine fed launcher constructed in accordance with the invention and attached to a rifle.

With initial reference to FIG. 1, there is shown a launching system 2 including a launcher 5 mounted under a barrel 6 of a rifle 10. However, launching system 2 can also be mounted to the side of barrel 6. Rifle 10 is preferably an M16 rifle or an M4 carbine equipped with Picatinny rails on the hand guards, but launching system 2 may be mounted to various types of military or civilian rifles. In any case, launching system 2 is preferably mounted so that it does not interfere with normal lethal operation of rifle 10 when fired or used with a bayonet (not shown).

As depicted, rifle 10 includes a central breech portion 12, a butt 14 extending rearward from breech portion 12 and a barrel 6 extending forwardly from central breech portion 12. Barrel 6 is provided with a flash arrester 18 mounted at its forward end 20. A forward sight 22 is mounted on barrel 6 and set back from forward end 20. A transport handle 24 includes a rear sight 25 and is mounted on central breech portion 12. A hand guard 26 extends along barrel 6 from breech portion 12 to forward sight 22. A grip 27 extends downward from central breech portion 12 and is located adjacent a trigger assembly 28. A magazine 30 extends downward from central breech portion 12 and is located just forward of trigger assembly 28. At this point, it should be noted that the details of the operation and construction of rifle 10 are not part of the invention. Therefore, the above description has been provided for the sake of completeness, but further description regarding rifle 10 can be found in U.S. Pat. No. 6,134,823, incorporated herein by reference. Instead, the invention is more particularly directed to launching system 2, how launching system 2 may be mounted to rifle 10 and the projectiles employed with launching system 2 as will be described in detail below.

As shown in FIG. 1, launcher 5 includes a barrel 32 with a breech 34 at a rear end 36 and a bore 37 leading to a muzzle 38 at a front end 40. A magazine 42 extends downward from breech 34. Barrel 32 is preferably made of a lightweight material, such as plastic. A trigger assembly 43 is located just forward of magazine 42. An adjustable and removable tactical handle 44 extends from barrel 32 at a point between trigger assembly 43 and muzzle 38. In the embodiment shown, launcher system 2 is connected to rifle 10 at two points. More specifically, front end 40 of launcher 5 is shown attached to barrel 6 of rifle 10 near forward sight 22 by a clamp bracket 46, while rear end 36 of launcher 5 is attached to breech portion 12 by a connector bracket 48. In the preferred embodiment, launcher 5 is used on a parent weapon equipped with Picatinny rails for mounting accessories along barrel 6. The Picatinny mount on launcher system 2 is articulated to allow regulation of fire to parent weapon's site 25, 22. The Picatinny rail system allows launchers to be attached on either side of barrel 6 or under barrel 6. If mounted on the side of barrel 6, launcher system 2 would not interfere with the standard vertical grip or the bayonet (not shown).

Figure 2:
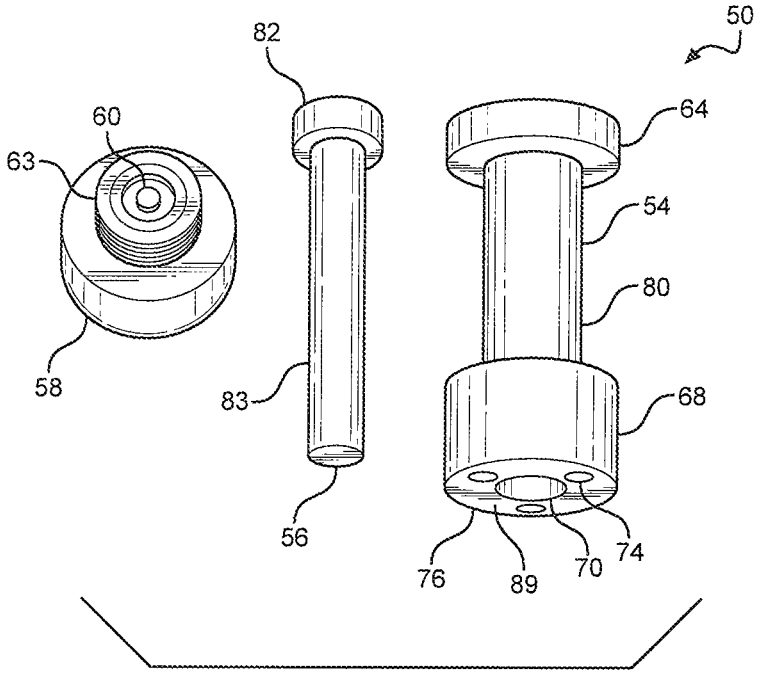
FIG. 2 is an exploded view of a projectile in accordance with a first preferred embodiment of the invention.

Turning now to FIG. 2 there is shown an exploded view of a projectile 50 designed to be fired mechanically from launcher 5 in accordance with a first preferred embodiment. Projectile 50 includes, as main components, a main body 54, a piston 56, a cylindrical cavity inside of nose 58 contains charge 60 including a primer and a gas-generating solid propellant, and an ogive or blunt dome-shaped nose 58 having a threaded portion 63 threadably secured to a front end 64 of body 54. As shown, threaded portion is hollow and receives charge 60 therein. Body 54 also includes front end portion 64, an enlarged diameter base portion 68 with a central piston hole 70 and three vent holes, one of which is labeled with reference numeral 74, at a rear surface 89 of end 76. A central connecting portion 80 connects front end portion 64 to enlarged diameter base portion 68. Preferably, piston 56 has an enlarged diameter piston head 82 and an elongated rod or shaft 83.

Figure 3:
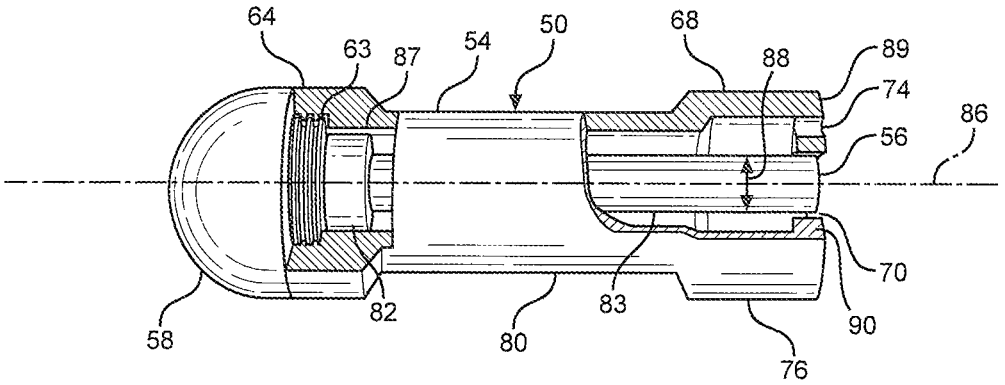
FIG. 3 shows a partially cut away perspective view of the projectile of FIG. 2 in an assembled configuration and having a piston in a retracted position.

FIG. 3 shows projectile 50 in a fully assembled configuration as projectile 50 is arranged just prior to firing. When assembled, piston 56 is located inside and along an axial centerline 86 of projectile body 54. Enlarged diameter piston head 82 is slightly smaller than an inside diameter 87 of projectile body 54 such that the arrangement allows piston 56 to slide relative to body 54. Hole 70 is just slightly larger than a diameter 88 of shaft 83 of piston 56, while also being smaller in diameter than enlarged diameter head 82 of piston 56. Just prior to firing, enlarged diameter piston head 82 is located just rearward of ogive-shaped nose 58, adjacent primer and propellant housing with charge 60, while elongated shaft 83 of piston 56 extends within central piston hole 70 in base portion 68 of projectile 50. In this manner, a terminal end (not labeled) of elongated shaft 83 is substantially flush with surface 89 of rear end 76 of projectile base portion 68 as clearly shown in this figure.

Figure 4:
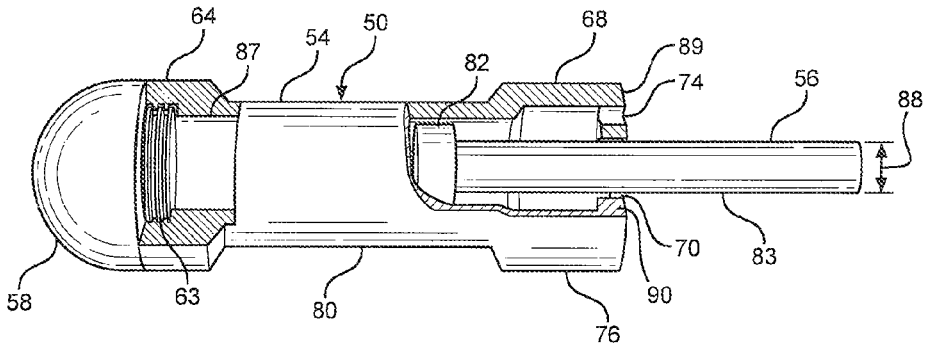
FIG. 4 shows a partially cut away perspective view of the projectile of FIG. 2 with the piston in a partially extended position.
Figure 5:
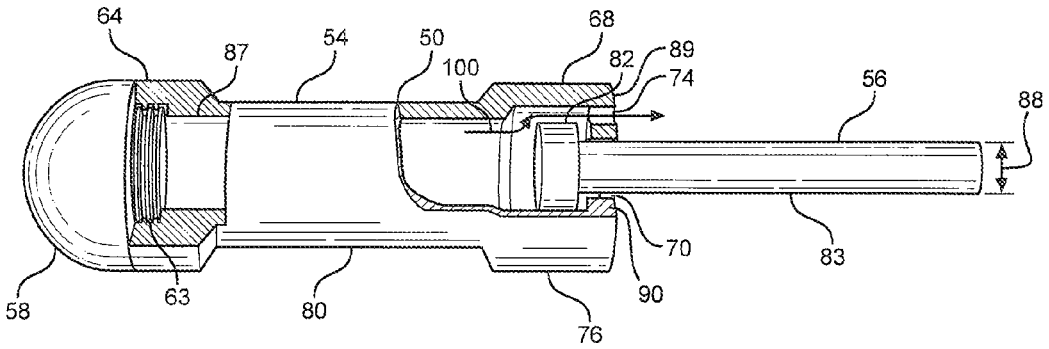
FIG. 5 shows a partially cut away perspective view of the projectile of FIG. 2 with the piston in a fully extended position.

As best seen in FIGS. 3-5, enlarged piston head 82 is movable within projectile body 54 from just behind the cylindrical cavity containing charge 60 towards base portion 68 of projectile body 54, which results in elongated shaft 83 extending or telescoping from rear end 76 of projectile 50. Piston 56 is shown partially extended in FIG. 4 and substantially fully extended in FIG. 5. Because enlarged piston head 82 is larger than central piston hole 70, piston head 82, in the fully extended position, abuts an inner radial rear wall 90 of base portion 68, thus retaining piston head 82 within projectile 50. Furthermore, ogive-shaped nose 58 is threadably or otherwise secured to front end 64 and also retains piston 56. As such, piston 56 is captive and cannot be completely removed from projectile 50.

Figure 6A:
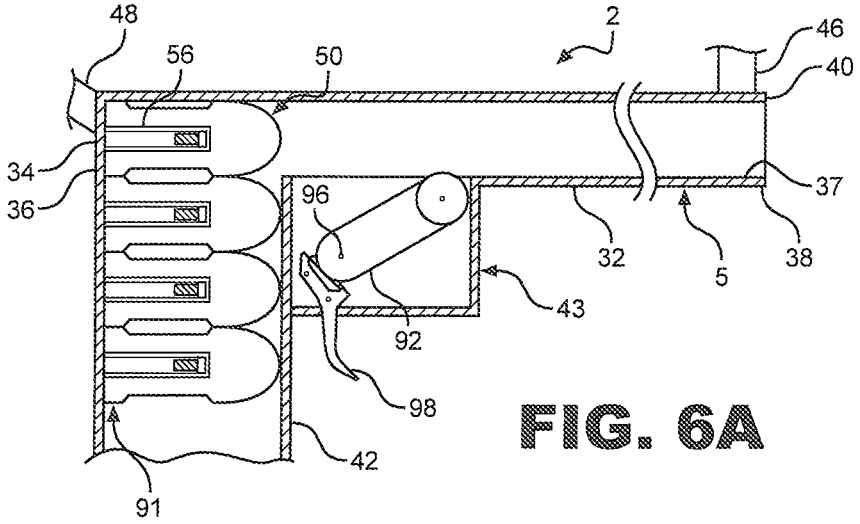
FIG. 6A is a cross sectional view showing operation of a mechanically operated launcher in a first stage of an operating cycle according to the first preferred embodiment of the invention.
Figure 6B:
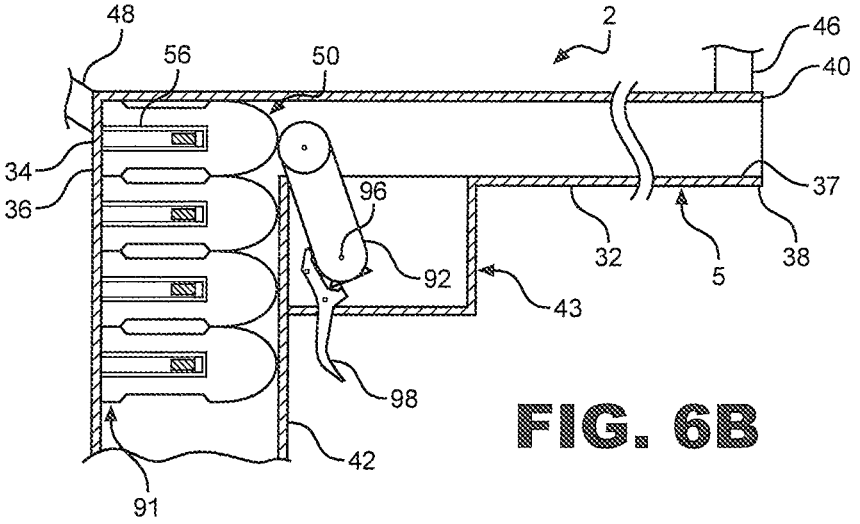
FIG. 6B is a cross sectional view showing operation of the mechanically operated launcher in a second stage of an operating cycle according to the first preferred embodiment of the invention.
Figure 6C:
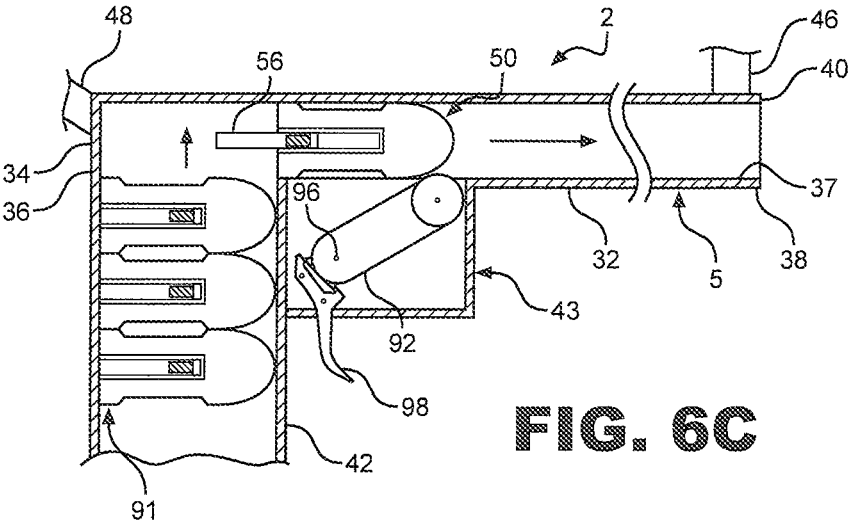
FIG. 6C is a cross sectional view showing operation of the mechanically operated launcher in a third stage of an operating cycle according to the first preferred embodiment of the invention.

Turning now to FIGS. 6A, 6B and 6C in order to show the details of operation in the mechanical mode, a cross section of launcher system 2 is depicted at three different times in a firing cycle. In FIG. 6A, launcher system 2 is shown with trigger assembly 43 in cocked or ready position, while projectile 50 is located in barrel 32 near breech 34. Magazine 42 is attached to barrel 32 and designed to contain numerous additional projectiles 91. Trigger assembly 43 includes a hammer mechanism 92 which is mounted for pivotal movement about an axis indicated at 96 and is biased for movement in a counterclockwise direction by a torsion or other spring (not shown). Trigger assembly 43 also includes a pivotally mounted trigger 98 in engagement with hammer mechanism 92. As depicted in FIG. 6A, hammer mechanism 92 and trigger 98 are located in a ready position spaced from projectile 50, with trigger 98 preventing hammer mechanism 92 from rotating.

In operation, projectile 50 is placed within launcher 5 with base portion 68 of projectile 50 set against breech 34 of launcher 5. Projectile 50 is aligned with bore 37 and faces muzzle 38. When trigger 98 is pulled, hammer mechanism 92 is released and forcibly rotates into engagement with projectile 50, as shown in FIG. 6B. The action of hammer mechanism 92 hitting projectile 50 initiates the primer and charge 60 located in the cylindrical cavity in nose 58, which rapidly generates hot gas acting on piston 56, forcing piston head 82 to move away from ogive-shaped nose 58. At this point, shaft 83 of piston 56 extends through hole 70, abuts breech 34 and pushes against breech 34 of launcher 5, thereby forcing projectile body 54 to rapidly accelerate toward muzzle 38 of launcher 5. Preferably, barrel 32 is rifled to allow spin stabilization of projectile 50. When projectile 50 travels a distance equal to the length of elongated shaft 83 minus the thickness of wall 90 in base 68, enlarged piston head 82 abuts rear wall 90 such that there is no longer any relative motion between piston 56 and projectile body 54. Also, hammer mechanism 92 is automatically pushed back to a cocked position by projectile 50 so as to be ready to fire again when another of additional projectiles 91 is aligned with barrel 32.

At this point in operation, projectile 50 has sufficient momentum to continue with its fully extended piston 56 towards front end 40 of barrel 32 as represented in FIG. 6C. Also, vent holes 74 located in base 68 of projectile 50 become fluidly connected to the hot gas located in front of piston 56 and thus the hot gas may travel around enlarged piston head 82 as shown by arrows 100 in FIG. 5. The hot gases exit main body 54 by being expelled through vent holes 74, thus creating a supplemental acceleration or at least reducing drag resulting in longer projectile ranges and safely discharge the pressure contained in the projectile. The burning primer and propellant work more efficiently and increase the pressure of hot gas more rapidly when the gas is initially trapped behind piston head 82 and then exits vent holes 74 only after piston 56 is fully extended than compared to a conventional rocket or other projectile without a piston. Preferably, burning charge 60 includes delaying ignition of some of charge 60 until after projectile 50 has left barrel 32.

Once projectile 50 has been launched, no casing is left in barrel 32. With no casing left in barrel 32 that must be ejected, reloading an additional projectile 91 becomes relatively easy and magazine 42 simply pushes an addition projectile into firing position preferably under the influence of a spring (not shown). In addition, since the hot gas is not trapped in barrel 32 but rather expands within projectile 50, barrel 32 may be made of relatively light material. Furthermore, the captive piston arrangement, in the absence of bypass venting also advantageously eliminates muzzle flash and the acoustic signal normally associated with propellant powered projectiles, however the absence of bypass venting results in a lower launch velocity for a given length of piston travel in the bore.

When launching system 2 is used in a non-lethal mode, the acceleration caused by piston 56 bearing against breech 34 is the predominate source of projectile kinetic energy. The force from the gas escaping from vent holes 74 serves only to add a small amount of kinetic energy and provides thrust in flight to maintain flight velocity against retardation caused by aerodynamic drag. However, when launching system 2 is used in a lethal mode, the jet of hot gas that escapes from vent holes 74 in base 68 of projectile 50 after piston 56 is fully extended produces the predominant acceleration of projectile 50. The difference between the two modes is primarily the type of and mass of the propellant charge used. Basically, in the non-lethal mode, the mass of the propellant is smaller than in the lethal mode. For the non-lethal projectile, there is a small mass of propellant and the burn rate decrease with time to produce a small steady thrust in flight. For the lethal projectile, the mass of the propellant is large and the burn rate is progressive to maintain large thrust and continued acceleration as projectile 50 moves away from breech 34 and eventually moves away from muzzle 38 of launcher 5 towards its target (not shown). For a non-lethal fire, the design impact velocity is preferably less than or equal to 300 ft/sec, while nose 58 of projectile 50 is blunt and may be compliant to minimize the likelihood of penetration into a target. For the lethal embodiment, the impact velocity is made greater than or equal to 800 ft/sec, while nose 58 of projectile 50 is preferably sharp and of a non-compliant material to enhance penetration.

Figure 7:
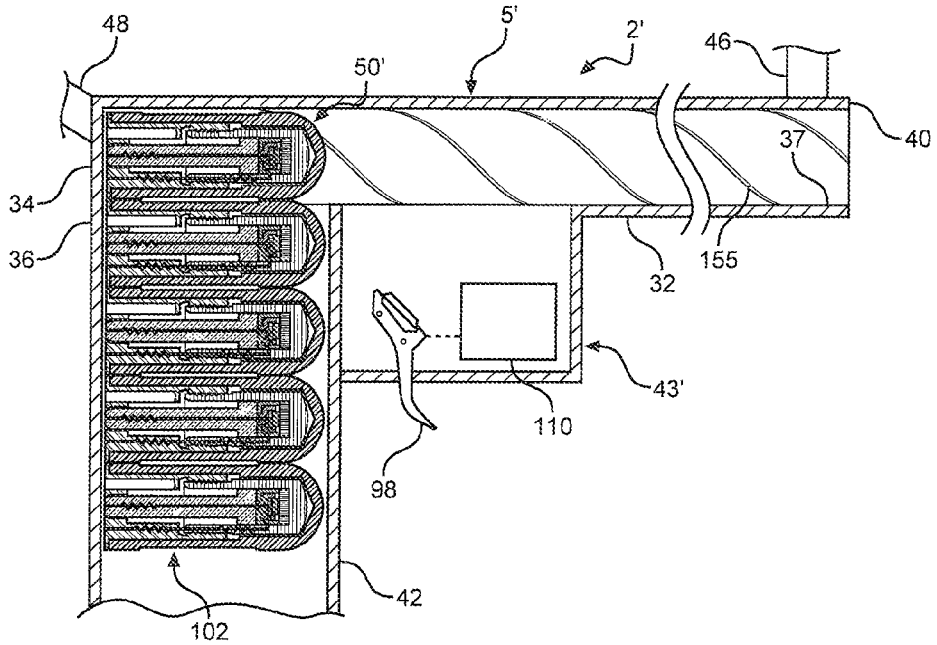
FIG. 7 is schematic view showing an electrically operated launcher according to a second preferred embodiment of the invention.
Figure 8:
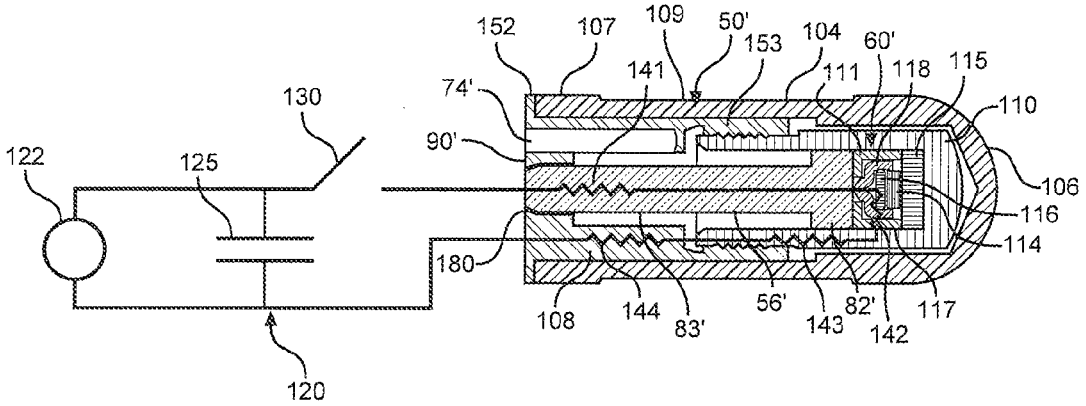
FIG. 8 is an enlarged schematic view of one of the fully assembled projectiles of FIG. 7 shown with a piston in the fully retracted position.

FIGS. 7 and 8 show a second preferred embodiment of the invention wherein an electric current is used to initiate a gas-generating solid propellant inside projectile 50'. Several parts of the second embodiment are the same as the first embodiment and are therefore represented by common reference numerals. As depicted in FIG. 7, several electrically activated projectiles 102 are mounted in launcher 5' with one projectile 50' in firing position in barrel 32. As best shown in FIG. 8, projectile 50', which preferably has an overall length of about 1.25 inches (approximately 3.2 cm) long with a diameter of 0.506 inches (approximately 1.285 cm) and weighs approximately 8 grams, includes a hollow outer body 104, preferably formed of Noryl, but which can be made from any suitable high-strength polymer, which includes a front ogive-shaped nosepiece 106 and an open trailing or rear portion 107. A base sleeve 108, preferably made of aluminum, is positioned within rear portion 107. Also shown in FIG. 8, a decreased diameter section 109 of projectile body 104 between nosepiece 106, and the rear portion 107. Using decreased diameter section 109 reduces the "in bore" friction which helps to keep the velocity high, results in less shot-to-shot velocity variation and also better centers projectile 50' in bore 37.

Located within outer body 104 is an internal combustion housing 110 which extends near nosepiece 106 and contains a charge 60' which includes an electrically initiated primer 111 and an amount of gas-generating solid propellant 115 as discussed further herein. The details of primer 111 are not part of the invention. Preferably, primer 111 is made of an electrically conductive material such as a brass electrode 116, with an electrically conductive explosive 114 pressed into a cup 117. Electrically conductive electrode 116 is fitted between explosive 114 and the bottom of cup 117. Insulating polymer 118 is used to isolate electrically conductive electrode 116 from electrically conductive cup 117. In any case, the details of primer can be found in U.S. Pat. No. 6,131,515, incorporated herein by reference. Alternatively, primer 111 is replaced with a reactive semiconductor bridge.

A firing circuit 120 includes a source of electrical voltage 122, such as a battery and voltage increasing circuit, a charging capacitor 125 and several portions of projectile 50', each of which acts as a resistor. More specifically, piston 56', which has an electrically insulating oxide coating on its exterior surfaces in contact with base 108 and combustion chamber 110 and primer cup 117, acts as a first resistor 141, primer 111 located in the cavity acts as a second resistor 142, combustion housing 110 acts as a third resistor 143 and aluminum base sleeve 108 acts as a forth resistor 144. This conductive path allows launcher 5' and projectile 50' to be an active part of firing circuit 120. When capacitor 125 in circuit 120 is charged, preferably to approximately 1.0 microfarad at 150 volts, capacitor 125 is short circuited across primer 111 of charge 60', causing a current to pass through explosive 114 causing detonation. The combination of fixed open breech 34 with electric ignition from circuit 120 permits very rapid rates of fire that may be in excess of 100 Hertz. Such rapid rates of fire can be used to vary the terminal effect from a single impact to multiple near simultaneous impacts. The synergistic effect of multiple near simultaneous impacts will be greater than multiple impacts over a longer time period. Multiple near simultaneous impacts will also be better at defeating simple counter measures such as padded clothing, because the first impact will compress the padding, decreasing its ability to dissipate the energy of the following impact or impacts. The electronic firing circuit 120 is preferably designed to select single or multiple shots per firing cycle.

Preferably, propellant 115 is also present, such as in the order of 45 mg, between primer 111 and the front of combustion chamber 110. Aluminum base sleeve 108 has an outer flange 152 that engages, preferably through a press-fit attachment, with outer body 104 and an inner flange 153 that is threadably connected to chamber 110 at 153 to encapsulate piston 56' in projectile 50'. As also clearly shown, base 108 is formed with an inner radial rear wall 90' provided with vent holes 74'. More details of base 108 are set forth below in the description of FIGS. 11 and 12.

Figure 9:
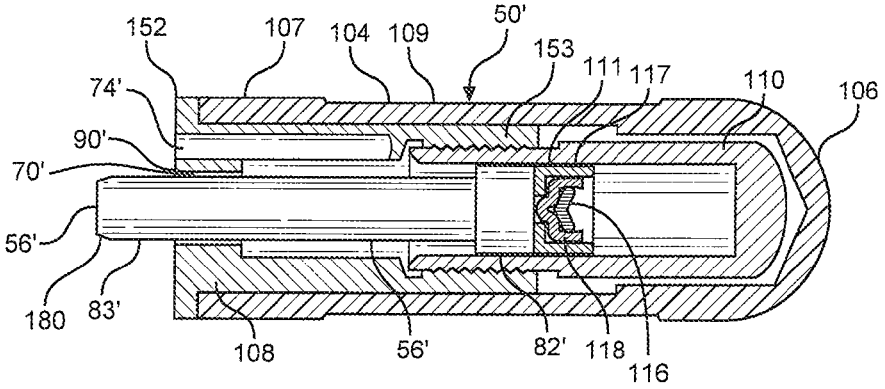
FIG. 9 shows a partially cut-away view of the projectile of FIG. 8 shown with the piston in a partially extended position.
Figure 10:
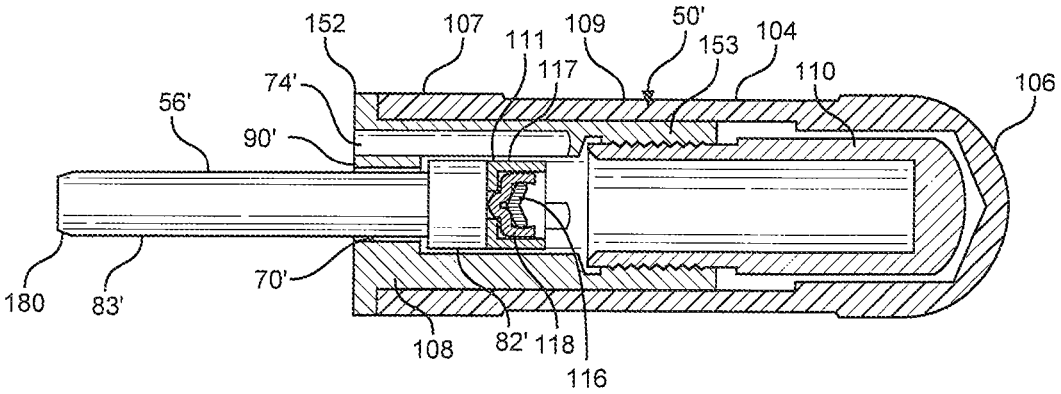
FIG. 10 shows a partially cut-away view of the projectile of FIG. 8 shown with the piston in a fully extended position.

The operation of projectile 50' in the second preferred embodiment is similar to the operation of projectile 50 in the first preferred embodiment with the exception of how the primer is initiated. Turning now to FIGS. 8-10, the projectile 50' is shown at difference times in a firing cycle. FIG. 8 shows projectile 50' before firing, such as when located in launcher 5' as shown in FIG. 7. Pulling trigger 98 causes circuit 120 to go through a firing cycle and thus initiate the primer which, in turn, ignites propellant 115 and generates hot gas against the primer which bears directly against enlarged diameter piston head 82'. As with the first embodiment, elongated shaft base 83' of piston 56' extends out of a hole 70' to push against breech 34 until shaft 83' reaches its fully extended position as represented in FIG. 10. Once again, in the fully extended position, hot gas may escape around piston head 82' and escape through vents 74' to provide additional acceleration and safely discharge pressure from within projectile 50' and launcher 5' may be used with lethal or non-lethal projectiles as described with reference to the first embodiment.

Preferably, propellant 115 is a relatively slow burning propellant. Faster propellants produce higher pressures that may deform piston 56' due to the rapid rise in force against breech 34. Preferably, a charge of 50 mg of a slower burning propellant, such as Hodgdon HS-6 ball propellant, is used. Slower burning propellants, such as Alliant Blue Dot, a shot gun powder, may be used but they are considered less desirable because they allow for un-burnt powder being ejected from combustion chamber 110 and un-burnt propellant flakes still contained inside combustion chamber 110. The intermediate burn rate Hodgdon HS-6 shows no evidence of incomplete combustion and produces consistent velocity. Also, barrel 32 is preferably provided with rifling 155 to allow spin stabilization of projectile 50'. Propellant 115 may also be of a decomposing compound such as, but not limited to, sodium azide which rapidly produces gas when initiated. Sorting primers 111 into groups that have a mass range of 1 mg or less also results in greater accuracy when projectiles are fired. Without sorting primers 111, some projectiles will fire with a velocity significantly lower than others. For example, the mass of 100 individual primers was weighed to 0.1 mg on an analytical balance. The average mass of the primers was 313.8 mg and the range of masses was 308.8 to 318.7 mg. Fourteen primers were carefully disassembled, the energetic material removed and the components washed and dried. The average mass of the primer components, less the energetic material, was 280.3 mg. By subtraction, the average mass of energetic material is 33.5 mg per primer. The large range in primer mass of 9.9 mg is likely due to variations in the mass of the energetic material. This variation in energetic material is 30% of the total primer energetic mass and 12% of the total energetic mass (including propellant 115). This large variation in energy content is likely responsible for large projectile velocity variations observed before sorting the primers by mass.

Figure 11:
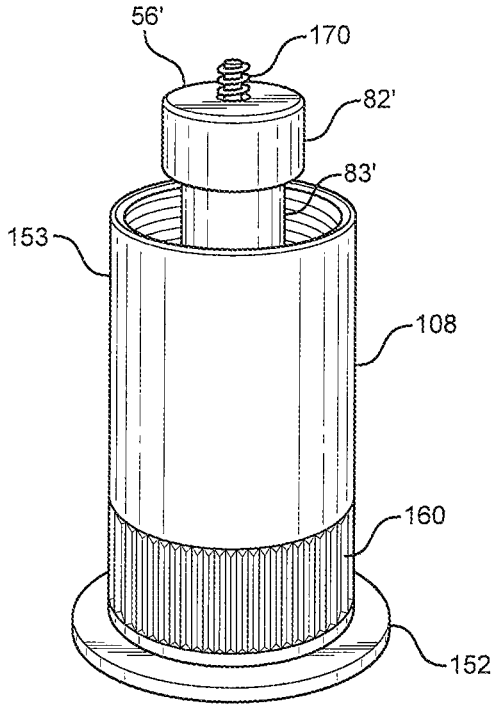
FIG. 11 shows a perspective view of a base sleeve of the projectile shown in FIG. 8, showing an external straight knurl.
Figure 12:
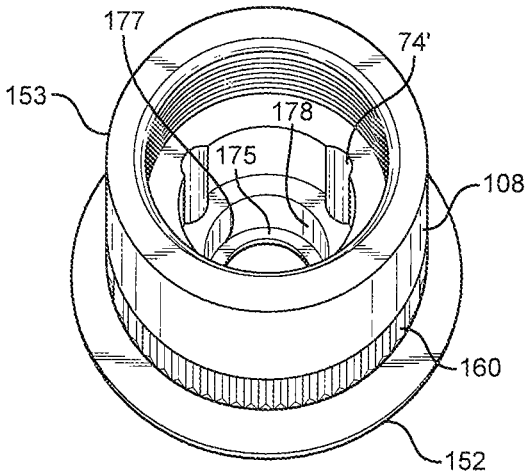
FIG. 12 shows a perspective view of the base sleeve of FIG. 11, with the piston removed, showing an internal shear flange on a piston shaft guide and the vents.

FIGS. 11 and 12 show a more detailed perspective view of base 108 of projectile 50' shown in FIG. 8, showing an external straight knurl 160 and an internal shear flange 175 on a piston shaft guide 178. As best seen in FIG. 11, piston 56' includes a spring 170 used for electrical contact to primer 111. Straight knurl 160 is a raised knife edged corrugation on the exterior surface of projectile base 108 that preferably extends in a longitudinal direction. Straight knurl 160 creates a mechanical binding between outer body 104 and projectile base 108 and more effectively transmits torque from rifling on bore 37 of barrel 32, through rear portion 107 of outer body 104 to the interior components of projectile 50'.

Straight knurl 160 prevents outer body 104 from rotating at a different rate than sleeve 108 and combustion chamber 110 and thus prevents an unstable projectile that tumbles in flight. This phenomenon of slippage has been observed in artillery projectiles that have driving bands to transfer torque from rifling to a projectile body. Straight knurl 160 also expands outer body 104, as can best be seen in FIG. 8, which results in greater engagement with rifling 155. Rifling 155 is shown as being on a thin steel sleeve liner placed inside plastic barrel 32 but rifling 155 may also be formed directly in barrel 32. Alternatively, base 108 may be located in projectile 50' using insert injection molding. Manufacture using insert injection molding will allow for an integral bonding of projectile polymer outer body 104 to sleeve 108 to which angular torque is applied from the angular acceleration imparted by rifling 155 in bore 37. Integral bonding of these two components will insure that there is no relative motion between the two components during projectile acceleration and they rotate about the axial centerline of projectile 50' in unison. Outer body 104 is preferably bonded to base sleeve 108 of projectile 50', in which case combustion chamber 110 is threadably attached to base sleeve 108 using a right hand thread (for right handed rifling). Alternatively, combustion chamber 110 is integrally bound to outer body 104, in which case base sleeve 108 will be threadably attached to combustion chamber 110 using a left handed thread (for the case of right handed rifling). The directionality of thread 153 joining combustion chamber 110 and base sleeve 108 is selected so that the torque applied by the angular acceleration causes tightening of the threadably connected components. Insert molding allows for a smaller metallic mass to be used in base sleeve 108 because polymer outer body 104 contributes to the mechanical properties of projectile 50'. Thus, the overall mass of projectile 50' can be decreased or more mass can be placed in nose piece 106. For example, a chemical marker or irritant that is released upon impact may be added to projectile 50'. In either case, the center of mass will be moved forward, thereby decreasing the amount of spin required for gyroscopic stability.

Preferably, the diameter of flange 152 on aluminum base 108 should be large enough to engage rifling 155 to ensure that aluminum base 108 and outer body 104 rotate in unison when traveling down bore 37 and during their ballistic travel to the target. The increased diameter, preferably 0.506 inches, also scrapes barrel 32 clean, resulting in little to no visible build-up of plastic or powder fouling in bore 37.

A spring 170 in head 82' of piston 56' provides positive electrical contact to primer 111 and prevents poor electrical contact between piston head 82' and primer 111. Preferably, a 0.059 inch hole is drilled 0.085 inches deep in the center of head 82' of piston 56'. Into this hole is inserted a small spring 170 preferably with an outside diameter of 0.057 inches and a length of 0.120 inches. Using spring 170 increases the reliability of ignition.

As shown in FIG. 12, a machined, tapered flange 175 is preferably formed on an inside bottom edge 177 of piston shaft guide 178. Flange 175 mates with a matching taper 180 best seen in FIGS. 8, 9 and 10 and located on shaft 83' of piston 56' and holds piston head 82' pressed against primer 111. Upon firing, tapered flange 175 is sheared by the action of piston 56' extending out from base piece 108. Tapered flange 175 also results in an improvement in accuracy by making the initial conditions of the propellant ignition more consistent. The greater consistency comes from flange 175 holding piston 56' against primer 111, thereby providing a more uniform initial resistance to the travel of piston 56' and the expansion of the propellant gas. By analogy, flange 175 acts like the crimp on a conventional rifle cartridge. The crimp on a conventional rifle cartridge controls the uniformity of the "bullet pull" which is the force to extract the bullet from the cartridge casing and has a significant effect on the internal ballistics.

Preferably, there is a tight tolerance between the outer diameter of piston shaft 83' and the inner diameter of piston shaft guide 178 in base 108 of approximately 0.00075 inches of clearance. This helps to better support piston shaft 83' and keep it aligned with the axial center line of projectile 50' during firing. When the propellant charge is ignited, the pressure inside combustion chamber 110 rapidly rises and may go as high as 30,000 psi. At these high pressures, the force on piston head 82' approaches 1,000 pounds (pressure times the area of the piston head). This large force will cause piston 56' to buckle when compressed. The closer the fit the between piston shaft 83' and piston shaft guide 178 the better piston 56' is supported and the less piston 56' can buckle and bind from the compressive load imposed thereon.

The radial spacing of vents 74 in base 68 and vents 74' in base of sleeve 108 should be large enough so as to not bisect piston shaft guide 178. Spacing vents 74 on a large radius also helps to better support piston shaft 83' during firing. The preferred radial spacing of vents 74 also results in the orifice of each vent being larger and circular instead of quarter moon-shaped.

Figure 13:
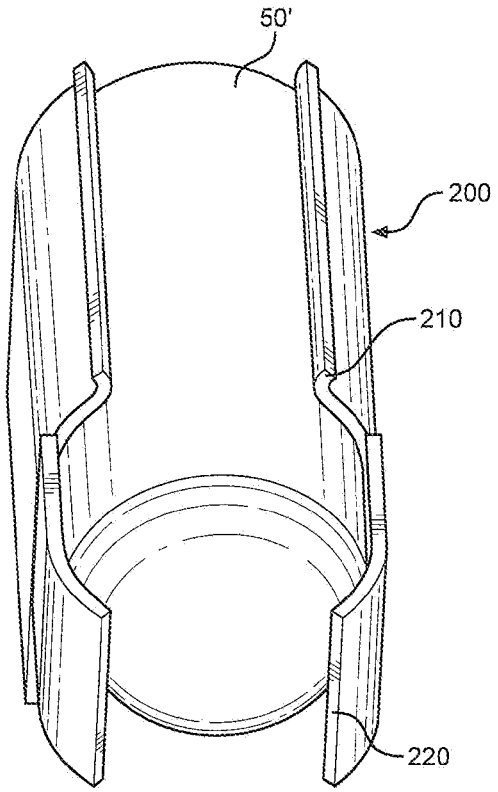
FIG. 13 shows a perspective view of a projectile located in a magazine in accordance with another embodiment of the invention.
Figure 14:
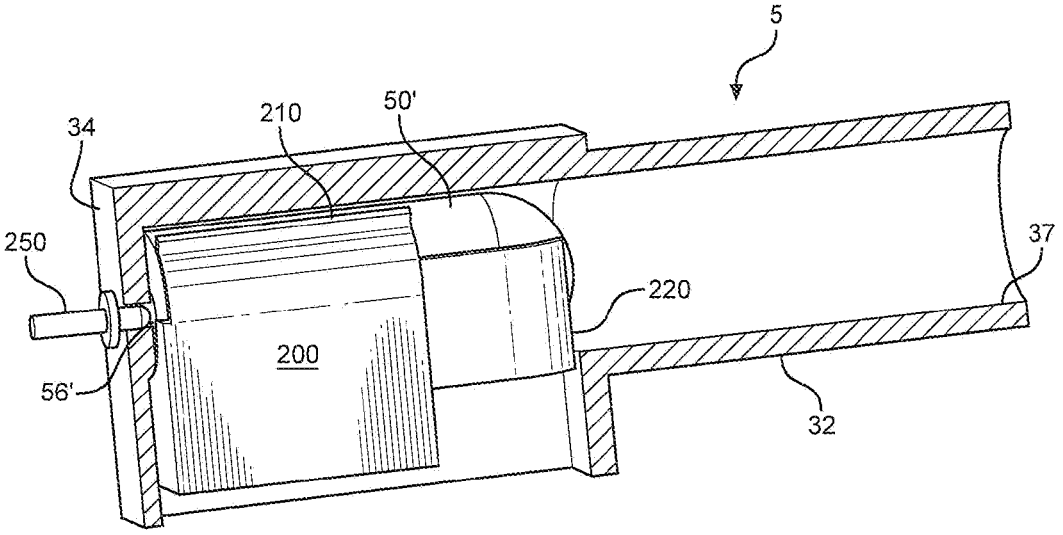
FIG. 14 shows the magazine of FIG. 13 located in a launcher.

FIGS. 13 and 14 show details of a magazine 200 according to another embodiment of the invention. Spring loaded top lips 210 located in the top of magazine 200 hold projectile 50' within magazine 200 when magazine 200 is removed from launcher 5. Top lips 210 also help to align magazine 200 so that projectile 50' is properly positioned relative to bore 37. Spring loaded front lips 220 are used to push projectile 50' against breech 34 of launcher 5. Spring loaded front lips 220 on nosepiece 106 are spread apart by the launching of projectile 50'. Spring loaded front lips 220 ensure that piston 56' is pressed against breech 34 prior to firing and that there is no free travel of piston 56' prior to contact with breech 34. Free travel of piston 56' prior to contact with breech 34 results in variations in launch velocity because the initial interior ballistics are affected when piston 56' is not restrained from motion by the inertial mass of projectile 50'. Free travel of piston 56' results in high velocity impacts on breech 34 and deformation of the base of piston 56'. The deformation of piston 56' reduces the energy imparted to projectile 50'. Also when piston 56' is pressed against breech 34, a sliding electrode 250 forms a proper electrical contact with piston 56'. Therefore, electrode 250 forms part of firing circuit 120 shown in FIG. 8.

In accordance with an aspect of the invention, it is desired to vary the launch velocity of projectile 50 depending on whether lethal or non-lethal force is desired the distance to the target on the relative toughness of the target. While the following discussion refers to mechanically initiated projectile 50 as an example, it should be understood that the principles described in this aspect of the invention also apply to electrically initiated projectile 50'. As discussed above with reference to FIG. 6C, projectile 50 is propelled out of barrel 32 in part due to hot gas being expelled out of vent holes 74. The launch velocity is increased as the pressure of the hot gas builds up in barrel 32 behind projectile 50 especially when barrel 32 is used with a sealed breech and conversely the launch velocity is reduced if the pressure of the hot gas does not build up. To this end, FIGS. 15-34 illustrate several ways to selectively contain the hot gas within barrel 32.

Figure 15:
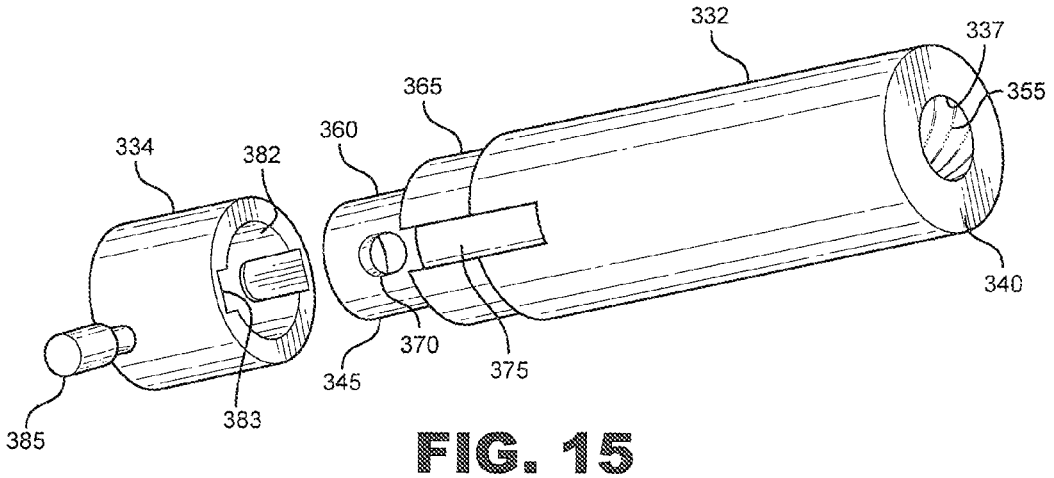
FIG. 15 shows an exploded view of a vented barrel and venting collar in a low velocity venting position in accordance with another embodiment of the invention.
Figure 16:
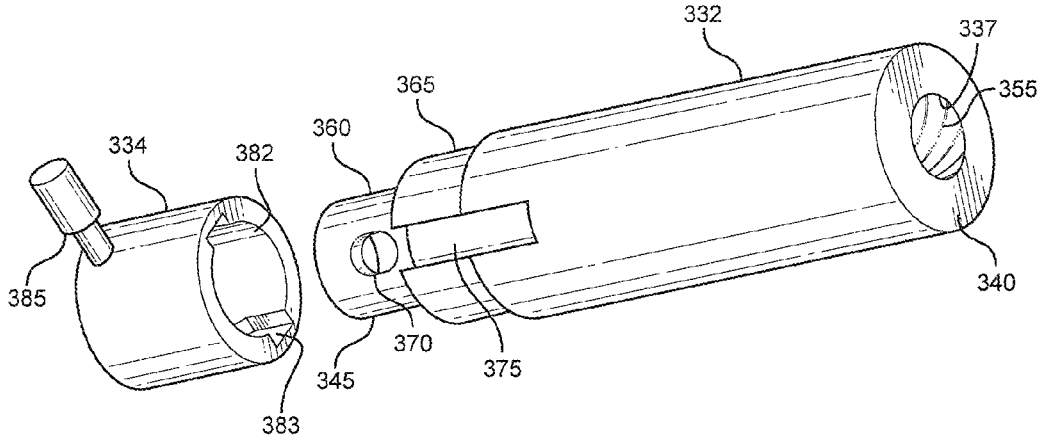
FIG. 16 shows an exploded view of the vented barrel of FIG. 15 in a high velocity non-venting position.
Figure 17:
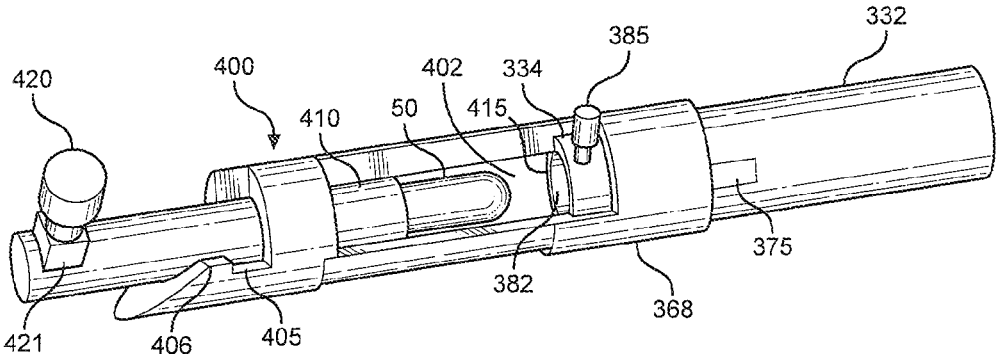
FIG. 17 shows a perspective view of the vented barrel of FIG. 15 in a high velocity non-venting position incorporated into a bolt action type launcher.
Figure 18:
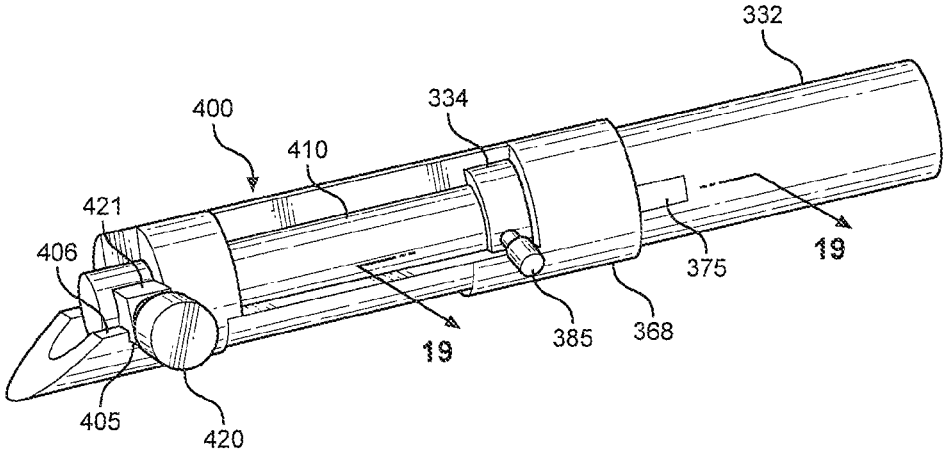
FIG. 18 shows a perspective view of the vented barrel of FIG. 17 in a low velocity venting position with the bolt in a closed position.
Figure 19:
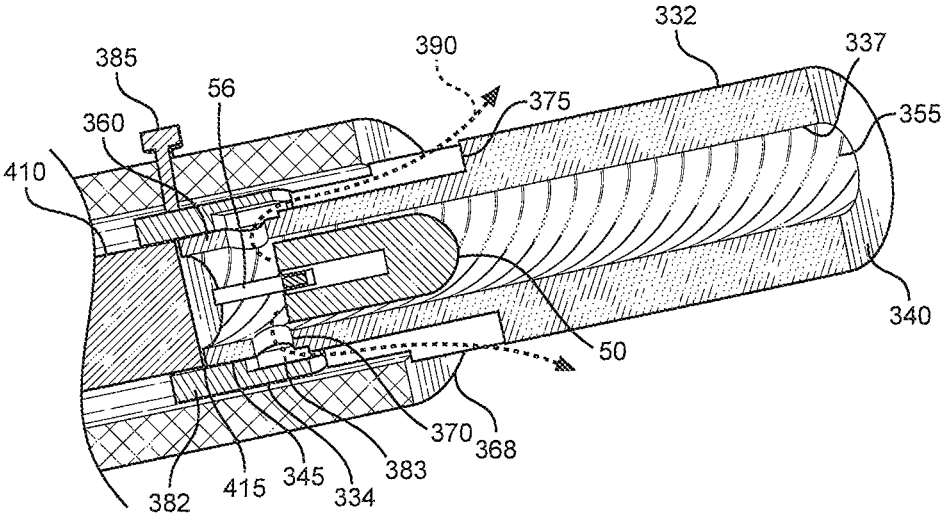
FIG. 19 shows a cross-section taken along line 19-19 of FIG. 18.
Figure 20:
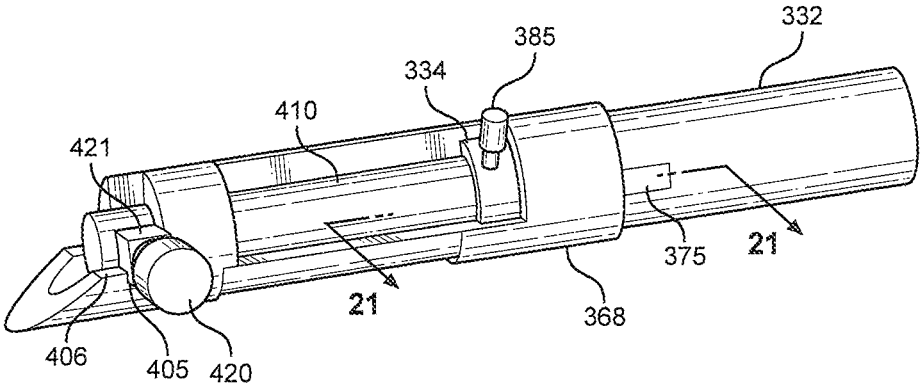
FIG. 20 shows a perspective view of the vented barrel of FIG. 18 with the venting collar in a high velocity non-venting position.
Figure 21:
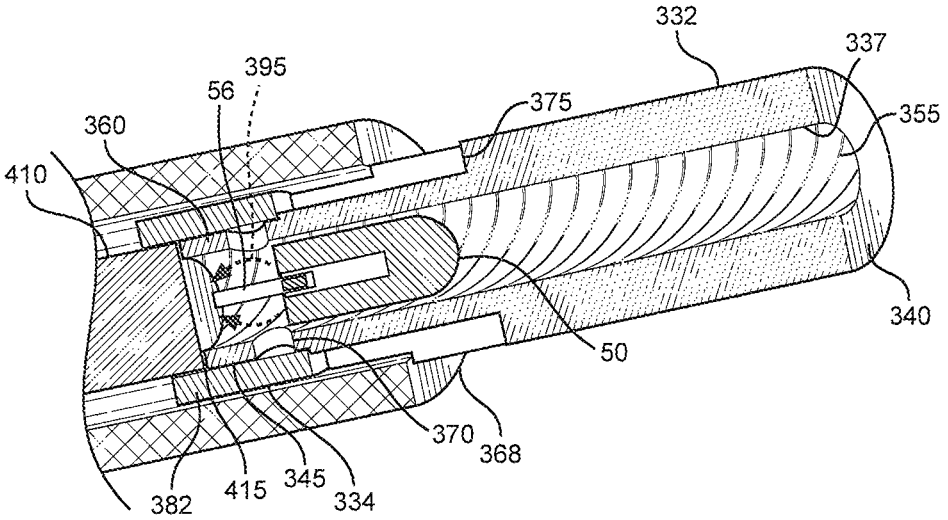
FIG. 21 shows a cross-sectional view taken along line 21-21 of FIG. 20.

More specifically, FIGS. 15-21 show details of a vented barrel 332 and an associated rotatable venting collar 334 for selectively containing the hot gas within vented barrel 332. Vented barrel 332 has a bore 337, which extends to a front end 340 of barrel 332. Bore 337 preferably has rifling 355 and a rear end 345 including a support surface 360 for rotatable venting collar 334 and a support surface 365 for a bolt housing 368 (see FIGS. 17-21). Vent holes 370 are located in rear end 345 of barrel 332 and extend from bore 337 to support surface 360. Grooves 375 are formed in barrel 332 and extend through and beyond support surface 365 towards front end 340. While only one groove 375 is shown in FIGS. 15 and 16, two or more circumferentially spaced grooves with associated passageways may be used. Similarly, one or more vent holes 370 may be employed. For example, multiple vent holes 370 and grooves 375 are shown in FIGS. 19 and 21. Rotatable venting collar 334 has an inner surface 382 sized to receive support surface 360. Inner surface 382 is provided with internal circumferentially spaced venting passageways 383 that extend axially along collar 334 and are adapted to selectively line up with and block vent holes 370. A handle 385 is provided on rotatable venting collar 334 to assist in rotating collar 334 from a low velocity venting position as shown in FIGS. 15, 18 and 19 to a high velocity non-venting position as shown in FIGS. 16, 20 and 21. Preferably, vent holes 370 are spaced from rear end 345 of barrel 332 by a distance that is less than the distance piston 56 projects out of projectile 50. In the venting position, passageways 383 line up both with vent holes 370 in barrel 332 and also with grooves 375 so that hot gas can pass through vent holes 370 into passageways 383 and then out to atmosphere through grooves 375 as best seen in FIG. 19 where the escaping gas is shown by arrows 390. Since bolt 410 acts as a sealing breech, in the non-venting position, inner surface 382 of rotating collar 334 blocks the flow of gas through vent holes 370 as best seen in FIG. 21 and indicated by arrows 395.

FIG. 17 shows barrel 332 of FIG. 15 attached to a bolt action loading mechanism 400 including housing 368 that fits over support surface 365 (see FIGS. 15 and 16). An opening 402 is formed to allow loading of projectile 50 and to allow for access to handle 385 for movement between vented and unvented positions. A notch 405 is located at the end of a ramp 406 to lock a bolt 410 in place. Bolt 410 is slidably supported in housing 368 and includes a handle 420 that extends laterally from bolt 410. Handle 420 includes a catch 421 that is shaped to fit into notch 405. Once a projectile 50 is placed into housing 368, handle 420 is used to move bolt 410 from an open position as shown in FIG. 17 to a closed and ready to fire position as shown in FIGS. 18-21. In the closed position, catch 421 is located in notch 405 to hold bolt 410 firmly in place.

Figure 22:
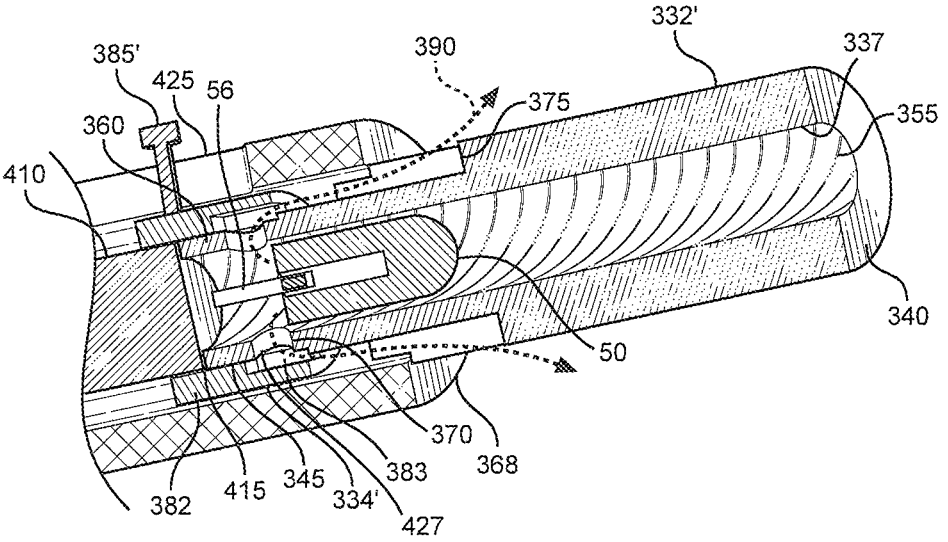
FIG. 22 shows a cross-section view of a vented barrel with a continuously variable venting area covered by a sliding collar that is located in the low velocity venting position.
Figure 23:
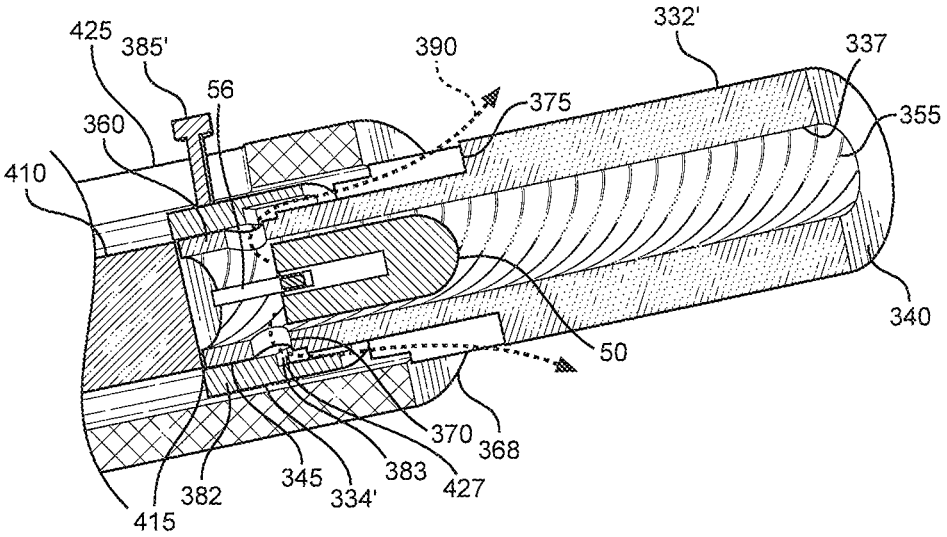
FIG. 23 shows the vented barrel of FIG. 22 with the sliding collar in an intermediate position.
Figure 24:
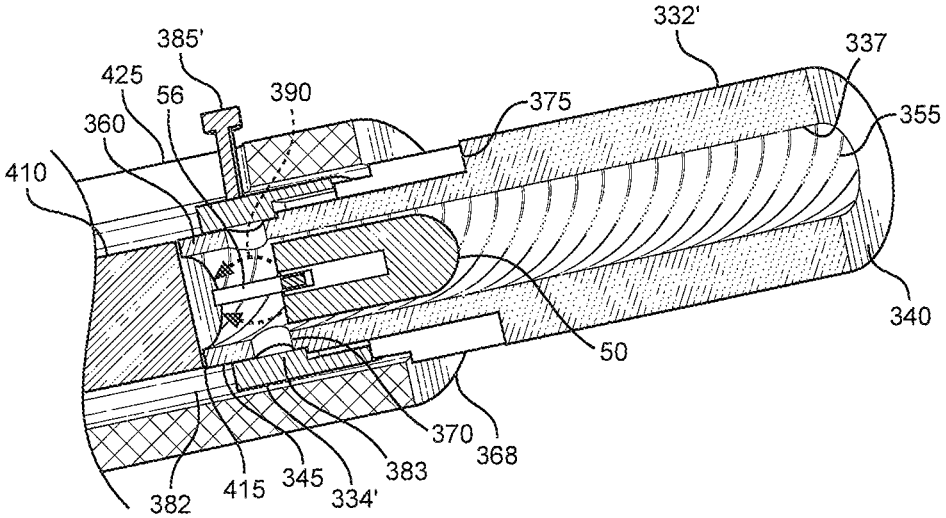
FIG. 24 shows the vented barrel of FIG. 22 with the sliding collar in a high velocity non-venting position.

Since the embodiment of FIGS. 22-34 employs several of the same parts as the embodiments of FIGS. 15-21, the same reference numerals are used and only the differences are discussed. FIGS. 22-24 show yet another preferred embodiment of the invention having a breech vented by an axially moving outer collar 334'. In this embodiment, collar 334' moves axially along barrel 332' from a low velocity venting position as shown in FIG. 22 to an intermediate venting position as shown in FIG. 23 and finally to a closed venting position as shown in FIG. 24. A slot 425 is provided to allow handle 385' to move through these three positions. Although shown as having three distinct positions, preferably collar 334' moves in a continuous manner and is held in-place by friction at any desired location between the venting position of FIG. 22 and the closed position of FIG. 24 alternatively a locking cam (not shown) may be used. As can best be seen in FIGS. 22 and 23, the amount of area of vent holes 370 left uncovered can be considered a vent area 427 which is incrementally or continuously varied between the venting position and the non-venting position. Therefore, vent holes 370 can be covered or blocked in a progressive manner to provide continuously variable control of the launch velocity. Incremental control is preferably provided by a series of stops or detents (not shown). Continuous variation of vent area 427 is effected by collar 334' which is held in place with sufficient friction to prevent movement except by intentional adjustment using handle 385'. Although not shown, a locking, latching or other retaining arrangement to prevent movement could also be employed.

Figure 25:
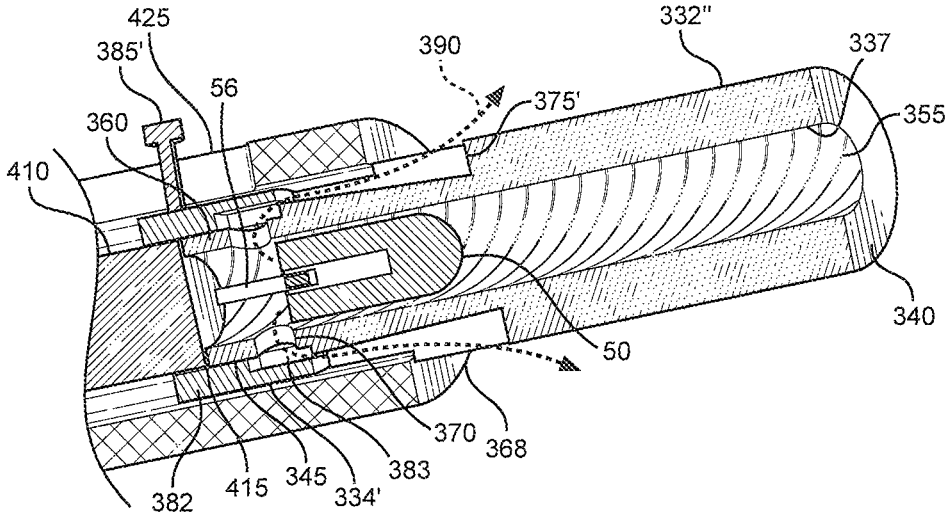
FIG. 25 shows a vented barrel having grooves which are progressively deeper towards the muzzle.
Figure 26:
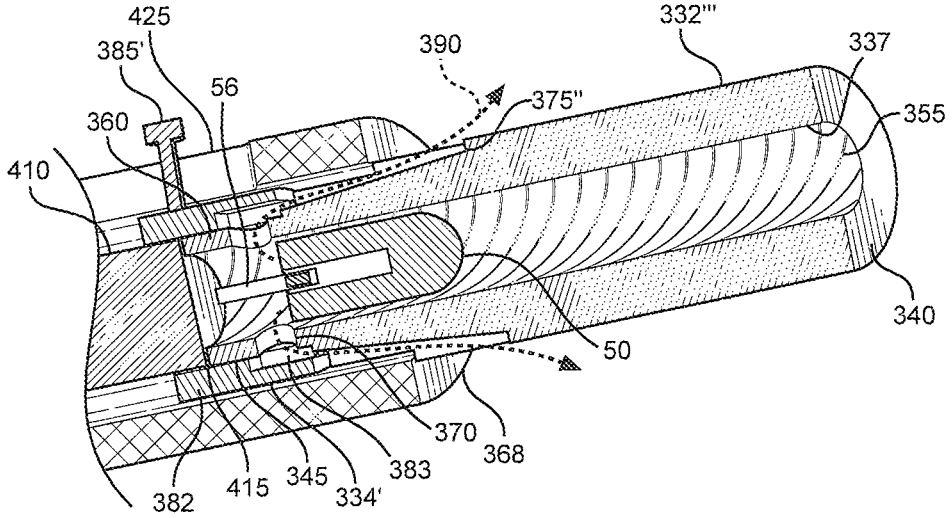
FIG. 26 shows a vented barrel having grooves which are progressively shallower towards the muzzle.

FIGS. 25 and 26 show vented barrels 332" and 332'''. More specifically barrel 332" is provided with a groove 375' that is slanted to control how fast gas is passed from barrel 332". Specifically, groove 375' is shown in FIG. 25 as slanted radially inwardly towards front end 340 of barrel 332" while, in FIG. 26, groove 375" is slanted radially outwardly towards front end 340 of barrel 332'''. Such slanting assists in controlling the rate at which gas vents. These arrangements are designed and chosen based whether the gas flow is subsonic, in which case the flow is governed by the average or minimum exit area or, if the gases are relatively hot, then the flow out of slots is supersonic and therefore governed by the throat area, i.e., the area of uncovered grooves 375". As such, the arrangements in FIGS. 25 and 26 are used for subsonic and supersonic flows respectively.

Figure 27:
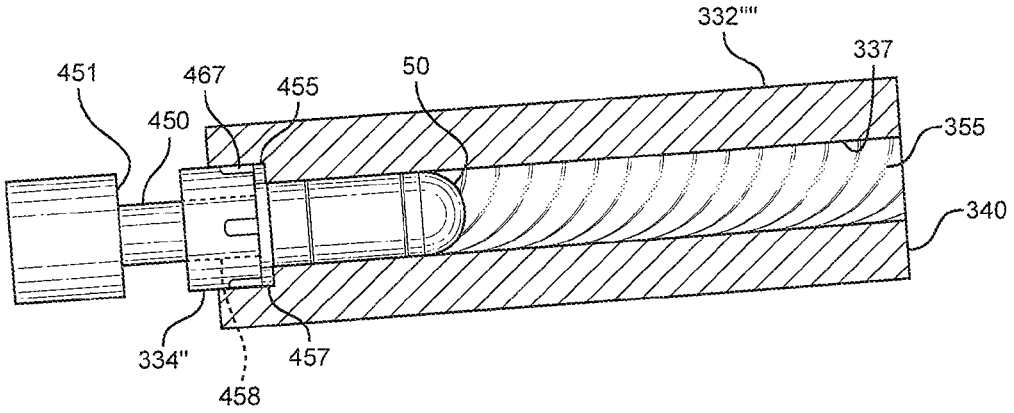
FIG. 27 shows a cross-sectional view of a vented barrel with a sliding collar in a high velocity non-venting position in accordance with another embodiment of the invention.
Figure 28:
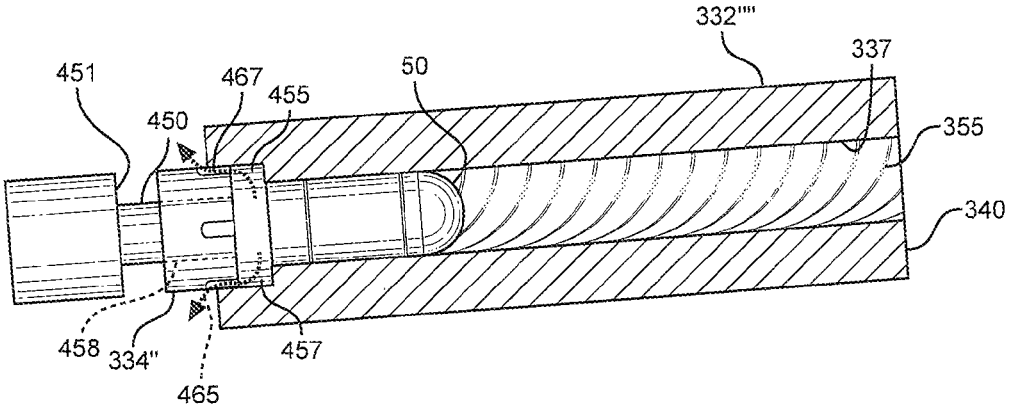
FIG. 28 shows a cross-sectional view of the vented barrel of FIG. 27 in an intermediate venting position.
Figure 29:
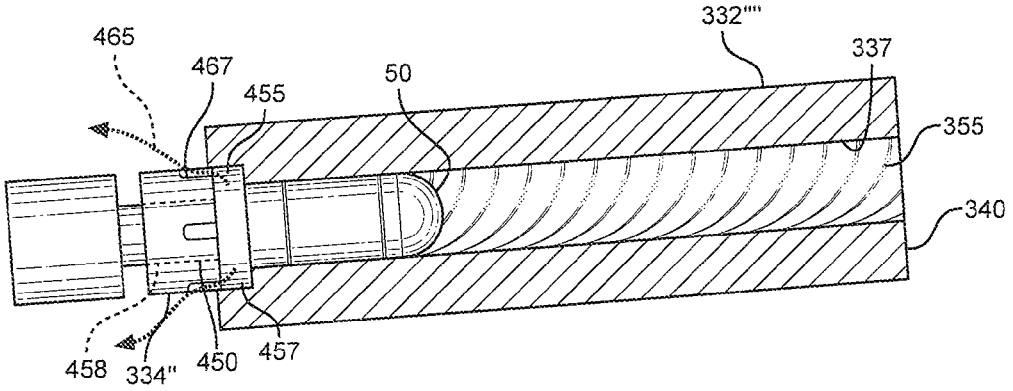
FIG. 29 shows a cross-sectional view of the vented barrel of FIG. 27 in another intermediate venting position.
Figure 30:
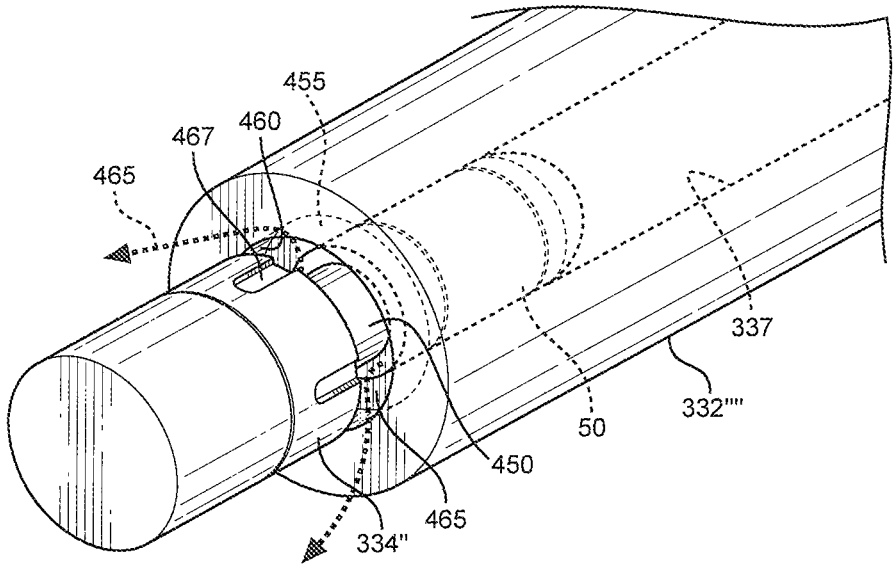
FIG. 30 shows a perspective view of the vented barrel of FIG. 27 in a low velocity venting position.
Figure 31:
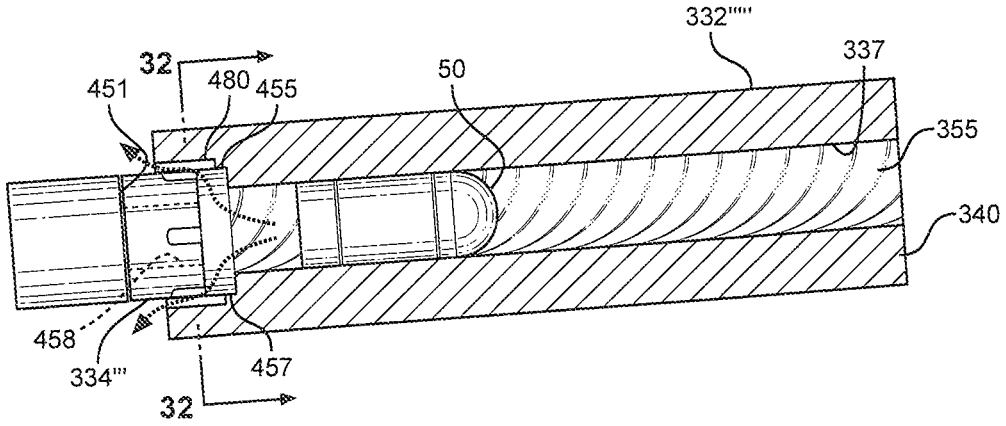
FIG. 31 shows a cross-sectional view of a vented barrel with a rotating collar in a low velocity venting position in accordance with another embodiment of the invention.

FIGS. 27-30 show yet another preferred embodiment of the invention having a breech vented by a sliding outer collar 334". A central rod 450 with an end stop 451 is attached to and extends away from barrel 332"". An enlarged cavity 455 is formed in barrel 332"" just behind projectile 50. Cavity 455 has an inner surface 457 that is designed to seat an outer surface of collar 334", while central rod 450 has an outer surface (not separately labeled) designed to slidably mate with an inner hole 458 in collar 334" so that collar 334" is slidable between a non-venting position as shown in FIG. 27 wherein collar 334" acts as a sealed breech by fitting into cavity 455 and blocks hot gases from escaping barrel 332"" and a venting position as shown in FIG. 30 wherein collar 334" has slid on central rod 450 until collar 334" abuts end stop 451 and allows hot gas to escape barrel 332"" as shown by arrows 465. Although not shown, a latch, catch or other retaining arrangement could be employed to selectively hold collar 334" in at least the non-venting position. Optionally slots 467 are provided in collar 334" and allow for continuously variable venting of the gas. FIGS. 28 and 29 show collar 334" slid to intermediate positions, but collar 334" may be placed anywhere between the fully closed position shown in FIG. 27 and the fully open position shown in FIG. 29, while being preferably held in place through friction or with a locking cam (not shown). With slots 467, collar 334" may be slid in a continuous manner to allow for variable control of gas venting and thus precise control of the launch velocity.

Figure 32:
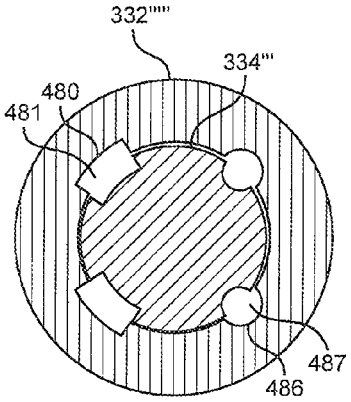
FIG. 32 shows a cross-section taken along the lines 32-32 of FIG. 31 wherein the collar has been rotated to provide the low velocity venting position.
Figure 33:
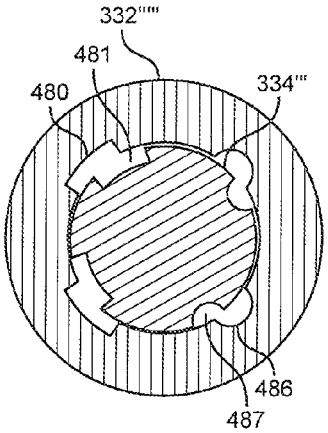
FIG. 33 shows a cross-section of the vented barrel of FIG. 31 wherein the collar has been rotated to provide an intermediate venting position.
Figure 34:
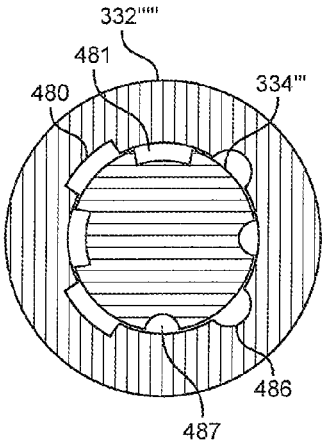
FIG. 34 shows a cross-sectional view of the vented barrel of FIG. 31 wherein the collar has been rotated to a closed, high velocity non-venting position.

FIGS. 31-34 show yet another preferred embodiment of the invention having a breech vented by an outer collar 334'''. In this embodiment, collar 334''' is rotated between a venting position shown in FIG. 32 through the intermediate position shown in FIG. 33 and finally to a non-venting position as shown in FIG. 34. The progressive venting is provided by the interaction of internal grooves 480 in barrel 332''''' with external grooves 481 found on collar 334'''. While grooves 480 and 481 are shown as rectangular in shape, alternative shapes, including semi-circular shapes, can be used as is shown in grooves 486 and 487. The overlap of the grooves as shown best in FIG. 32 provide space for a gas to vent as shown by the arrows in FIG. 31.

Figure 35:
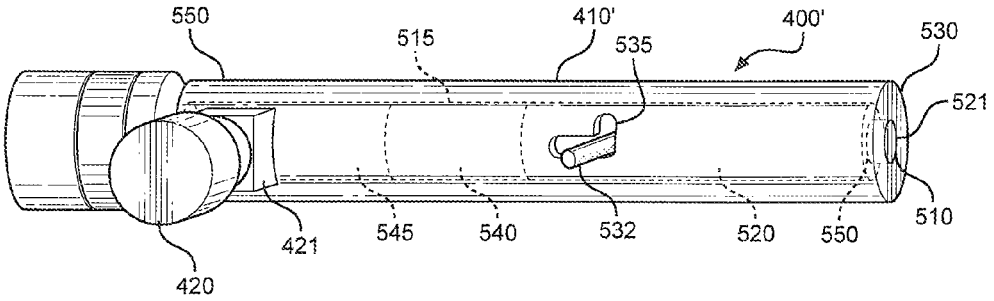
FIG. 35 shows perspective view of a sliding breech face with an energy absorbing plug shown in phantom in an unlocked low velocity position.
Figure 36:
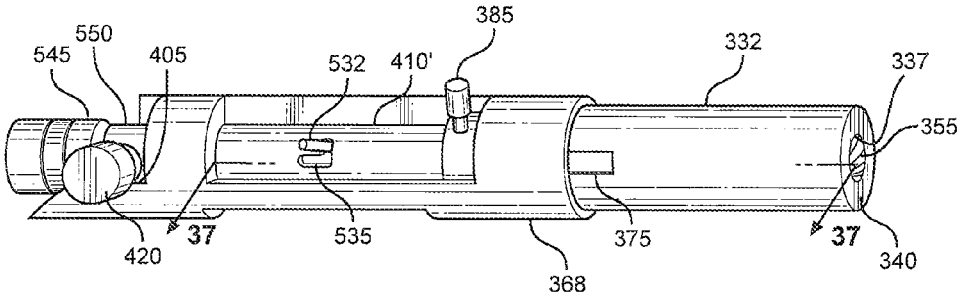
FIG. 36 shows a perspective view of a vented barrel in a high velocity non-venting position with a bolt action system having a bolt with a sliding breech face in a locked high velocity position.
Figure 37:
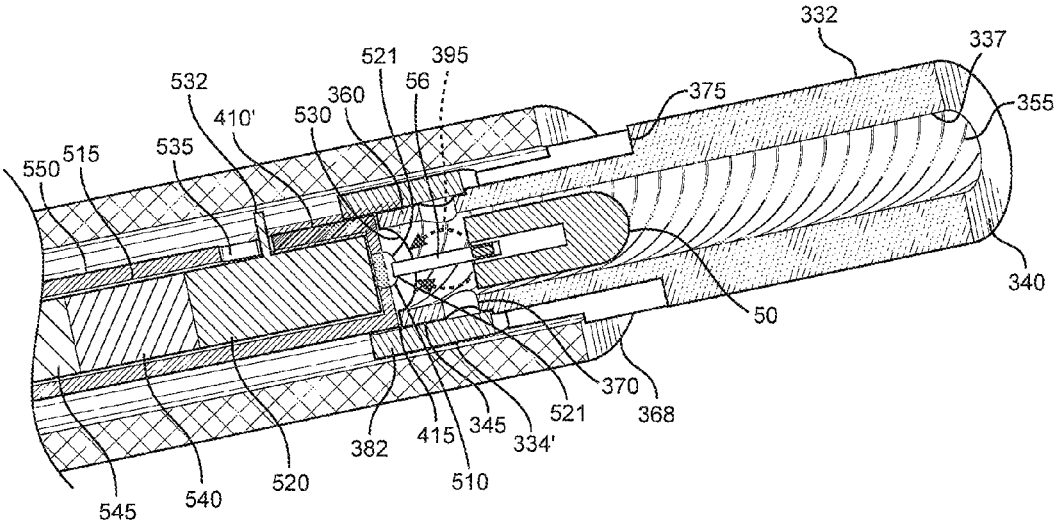
FIG. 37 shows a cross-sectional view take along line 37-37 of FIG. 36.

FIGS. 35-37 show a sliding breech bolt assembly 400' with a sliding breech face 510 used to vary the launch velocity of projectile 50 (or 50') by dissipating energy generated by piston 56 extending from projectile 50. A hollow bolt 410' is provided with an internal bore 515 that extends the axial length of hollow bolt 410'. A sliding breech 520 mounted in bore 515 supports sliding breech face 510 that extends through a small hole 521 in an end face 530 of hollow bolt 410'. While breech bolt assembly 400' is described in a preferred embodiment as a bolt action breech having a sliding portion, i.e., sliding breech 520, the breech could also be formed as a non-bolt action breech with a sliding portion. Preferably, sliding breech 520 is made from steel, or a mixture of steel and aluminum. A detent 532 extends laterally from sliding breech 520 and into an L-shaped slot 535 located in bolt 410'. Detent 532 can be arranged in either a locked position as shown in FIGS. 36 and 37 to prevent axial motion of sliding breech 520 or an unlocked position as shown in FIG. 35 which does allow relative axial motion. Behind sliding breech 520 is an energy absorbing plug 540, preferably constituted by an energy absorbing polymeric material such as urethane or a coiled spring. An adjustable plug 545 is mounted at rear end 550 of hollow bolt 410' and screws into internal bore 515 to compress against energy absorbing plug 540 in order to create a preload to keep sliding breech face 510 biased to a forward position. When loaded and ready to fire, piston 56 of projectile 50 bears directly on sliding breech face 510. When detent 532 is in the locked position, piston 56 is able to provide a maximum launch velocity for projectile 50. When detent 532 is in the unlocked position, piston 56 will push sliding breech face 510 rearwardly against energy absorbing plug 540 and thus provide a reduced launch velocity for projectile 50. The amount of reduction of launch velocity is controlled by the amount of preload placed on energy absorbing plug 540 by adjustable plug 545. In FIGS. 36 and 37, a barrel and bolt assembly is shown with both a vented barrel 332 and a sliding breech face 510 in one unit. Overall in each embodiment disclosed there is shown a velocity variator that varies the velocity of projectile 50. The velocity variator is configured to shift relative to the barrel to selectively vary a launch velocity of the projectile from the launcher and may be constituted by collar 334, 334', 334", 334''', 334"", sliding breech face 510 or both.

The accuracy of the disclosed launcher has been measured experimentally to determine how closely the fired projectile's impact to the aiming point on the target. The accuracy of the weapon is influenced by the precision (how closely together each fired rounds impacts to the others when aimed at the same spot) of the weapon/ammunition combination, the trajectory, the time of flight, and environmental influences such as wind. Typically, it is the precision of a weapon/ammunition combination that is measured. Several methods of measuring and recording the dispersion of projectile impacts, when the gun is aimed at the same spot, are used. The Department of Defense (DOD) tends to report group sizes as a mean radius from the geometric center of the group. In the non-DOD market, group size is often reported as the extreme center-to-center spread of the group or as the diameter of the smallest circle that can completely cover the group. Lastly, some ballistic laboratories report group size as standard deviation along the X and Y axis of the impact locations relative to the center of the group.

For the launcher, we have reported the group by three methods: extreme spread; mean radius; and standard deviation (sigma) X and Y. Table 1 gives experimentally measured group sizes for 7, 9 and 10 shot groups fired at 30 yards using barrels of 18, 10 and 4.85 inches in length.

TABLE 1

Experimentally measured group sizes for projectiles fired from a launcher 5 on a fixed mount at range of 30 yards (all measurements relative to center of impact).

| Launcher | Range (yards) | # of Shots | Extreme spread (inch) | Mean Radius/σ (inch) | $\sigma_x$ (inch) | $\sigma_y$ (inch) |
|---|---|---|---|---|---|---|
| 18 inch barrel open breech | 30 | 10 | 5.92 | 1.20/1.10 | 0.29 | 1.06 |
| 18 inch barrel open breech | 30 | 9 | 6.82 | 1.39/1.37 | 0.25 | 1.44 |
| 10 inch barrel open breech* | 30 | 7 | 6.56 | 1.78/1.2 | 0.38 | 1.37 |
| 10 inch barrel closed breech | 30 | 9 | 3.53 | 1.32/0.51 | 0.35 | .49 |
| 4.85 inch barrel closed breech | 30 | 7 | 6.46 | 2.16/1.09 | 0.72 | 1.02 |

*This group was fired before primers were sorted by mass. Two shots of the nine shots were not considered because they were significantly lower in velocity.

Based on the above, it should be readily apparent that the caseless launching system 2, 2' of the invention is advantageously lightweight, can be used with both lethal and non-lethal projectiles, and is small enough to be attached to a rifle without interfering with the main operation of the rifle. In any case, although described with reference to preferred embodiments of the invention, it should be readily understood that various changes and/or modifications could be made to the invention without departing from the spirit thereof. For instance, the launcher does not have to be used with a rifle and may be as a stand-alone weapon. Also, the projectile does not need to be 0.506" in diameter. Larger or smaller diameter projectiles are used to vary the impact effect. Furthermore, the light design enables the launcher to be carried hidden, for example in a policeman's baton. Also, instead of using a primer, a reactive semi-conductor bridge can be used to ignite the propellant. The ambient temperature affects the initial combustion rate of nitrocellulose based propellants. Higher ambient temperatures result in higher muzzle velocity for standard small and large arms. Lower ambient temperatures result in lower muzzle velocity. By design of the reactive semi-conductor bridge it can be possible to vary the energy output by varying the amount of electrical energy input into the reactive semi-conductor bridge. Thus, the total energy imparted to the projectile could be varied to change the launch velocity or the energy output could be varied to compensate for ambient temperature. Also the use of the reactive semi-conductor bridge provides a uniform method of ignition. Finally, an adjustable stop may be provided for the lever extending out of the sliding breech to permit for varying the distance the slide breech moves when a projectile is fired to provide even greater control of the launch velocity of the projectile. In general, the invention is only intended to be limited by the scope of the following claims.

We claim:

1. A launcher system comprising:

a projectile including:

a main body having at least one vent hole, and a charge provided in the main body; and a launcher including:

a barrel adapted to receive the projectile;

a velocity variator configured to shift relative to the barrel to selectively vary a launch velocity of the projectile from the launcher;

a sealed breech; and a mechanism for activating the projectile, wherein said barrel includes a vent hole or a cavity and said velocity variator is constituted by a collar formed with a passageway being mounted on the barrel whereby, when the mechanism activates the projectile and the charge is initiated, gas is created which exits the main body through the at least one vent hole to provide thrust for the projectile, and the collar is selectively movable from a non-venting position blocking the gas from exiting the vent hole or cavity to a venting position allowing the gas to pass from the barrel through the vent hole or cavity in the barrel into the passageway formed in the collar and to atmosphere whereby movement of the collar controls the launch velocity of the projectile.

2. The launcher system of claim 1, wherein the barrel includes the vent hole, and wherein the collar is rotatable about the barrel from the venting position to the non-venting position so as to cover the vent hole in a progressive manner to provide continuous variable control of the launch velocity.

3. The launcher system of claim 1, wherein the barrel includes the cavity, and wherein the collar is slidable relative to the barrel between the venting position and the non-venting position so as to cover the cavity in a progressive manner to provide continuous variable control of the launch velocity.

4. The launcher system of claim 1, wherein the barrel includes a groove that aligns with the passageway when the collar is in the venting position, said groove being slanted to control how fast the gas passes from the barrel.

5. The launcher system of claim 1, further comprising: a handle extending from the collar for selectively moving the collar from the venting position to the non-venting position.

6. The launcher system of claim 1, wherein the velocity variator is constituted, at least in part, by a portion of the breech which is configured to slide relative to the barrel when the launcher is fired to vary the launch velocity of the projectile from the launcher.

7. The launcher system of claim 6, further comprising an energy absorbing plug located behind the portion of the breech.

8. The launcher system of claim 7, further comprising a bolt formed with an internal bore, the portion of the breech and the energy absorbing plug being located in the internal bore.

9. The launcher system of claim 8, further comprising an adjustable plug located in the internal bore, with the adjustable plug being configured to apply a preload to the energy absorbing plug.

10. The launcher of claim 8, further comprising a detent connected to the portion of the breech, wherein the bolt includes a slot and said detent is movable in the slot from a locked position, preventing the portion of the breech from moving, to an unlocked position, allowing the portion of the breech to move in order to reduce the launch velocity of the projectile.

11. The launcher of claim 10, wherein the portion of the breech includes a breech face configured to be aligned with a piston located in the projectile, whereby additional energy is imparted to the projectile when the detent is in the locked position and more energy is absorbed by the energy absorbing plug when the detent is in the unlocked position.

12. The launcher of claim 11, wherein the energy absorbing plug is made of urethane.

13. The launcher of claim 11, wherein the energy absorbing plug is constituted by a coil spring.

14. A method of varying a launch velocity for a projectile fired from a barrel of a launcher that has a breech comprising:

a) initiating a charge provided in a main body of the projectile to generate charge gas, venting the charge gas through at least one vent hole in the main body to provide thrust for the projectile, and shifting a collar from a non-venting position blocking the charge gas from exiting a vent hole or a cavity provided in the barrel to a venting position allowing the gas to pass from the barrel through the vent hole or cavity into a passageway formed in the collar and to atmosphere, so as to slow the launch velocity of the projectile from the launcher; or b) sliding a portion of the breech relative to the barrel when the launcher is fired to reduce the launch velocity of the projectile from the launcher; or c) both a) and b).

15. The method of claim 14, wherein the barrel includes the vent hole, and wherein shifting the collar includes rotating the collar about the barrel between the venting position and the non-venting position so as to cover the vent hole in a progressive manner to provide continuous variable control of the launch velocity.

16. The method of claim 14, wherein the barrel includes the cavity, and wherein shifting the collar includes sliding the collar relative to the barrel between the venting position and the non-venting position so as to cover the cavity in a progressive manner to provide continuous variable control of the launch velocity.

17. The method of claim 14, wherein shifting the collar includes aligning a groove of the barrel with the passageway when the collar is in the venting position.

18. The method of claim 14, wherein shifting the collar includes manually moving the collar between the non-venting and venting positions with a handle extending from the collar.

19. The method of claim 14, wherein sliding the portion of the breech includes moving a detent in a slot provided in a bolt formed with an internal bore from a locked position preventing the portion of the breech from moving, to an unlocked position, allowing the portion of the breech to slide relative to the barrel in order to reduce the launch velocity of the projectile.

20. A launcher system comprising:

a projectile including:

a main body having at least one vent hole, and a charge provided in the main body; and a launcher including:

a barrel adapted to receive the projectile;

a sealed breech; and a velocity variator configured to shift relative to the barrel to selectively vary a launch velocity of the projectile from the launcher, wherein the velocity variator is constituted, at least in part, by a portion of the breech which is configured to slide relative to the barrel when the launcher is fired to vary the launch velocity of the projectile from the launcher.

* * * * *